US010264387B2

(12) United States Patent
Murata et al.

(10) Patent No.: US 10,264,387 B2
(45) Date of Patent: Apr. 16, 2019

(54) OUT-OF-HEAD LOCALIZATION PROCESSING APPARATUS AND OUT-OF-HEAD LOCALIZATION PROCESSING METHOD

(71) Applicant: JVC KENWOOD Corporation, Yokohama-shi, Kanagawa (JP)

(72) Inventors: Hisako Murata, Yokohama (JP); Masaya Konishi, Yokohama (JP); Yumi Fujii, Yokohama (JP)

(73) Assignee: JVC KENWOOD CORPORATION, Kanagawa (JP)

( * ) Notice: Subject to any disclaimer, the term of this patent is extended or adjusted under 35 U.S.C. 154(b) by 0 days.

(21) Appl. No.: 15/923,328

(22) Filed: Mar. 16, 2018

(65) Prior Publication Data

US 2018/0206058 A1 Jul. 19, 2018

Related U.S. Application Data

(63) Continuation of application No. PCT/JP2016/003153, filed on Jul. 1, 2016.

(30) Foreign Application Priority Data

Sep. 17, 2015 (JP) ..... 2015-184223

(51) Int. Cl.
*H04S 7/00* (2006.01)
*H04S 3/00* (2006.01)
(Continued)

(52) U.S. Cl.
CPC ..... *H04S 7/304* (2013.01); *H04R 3/04* (2013.01); *H04R 5/04* (2013.01); *H04S 3/008* (2013.01);
(Continued)

(58) Field of Classification Search
None
See application file for complete search history.

(56) References Cited

U.S. PATENT DOCUMENTS 5,982,903 A * 11/1999 Kinoshita ..... H04S 1/005 381/17
6,023,512 A * 2/2000 Matsuo ..... H04S 1/002 381/17
(Continued)

FOREIGN PATENT DOCUMENTS

JP 2002135898 A 5/2002

*Primary Examiner* — Curtis A Kuntz
*Assistant Examiner* — Qin Zhu
(74) *Attorney, Agent, or Firm* — Procopio, Cory, Hargreaves & Savitch LLP

(57) ABSTRACT

An out-of-head localization processing apparatus according to an embodiment includes headphones, left and right microphones, a measurement unit configured to measure left and right headphone transfer characteristics, respectively, an inverse-filter calculation unit configured to calculate inverse filters of the headphone transfer characteristics, a correction unit configured to calculate correction filters by correcting the inverse filters, and an input unit configured to receive a user input. The correction unit corrects the inverse filters by using a predefined correction function in a first frequency band. The correction unit corrects the inverse filters according to a correction pattern selected based on the user input in a second frequency band.

6 Claims, 17 Drawing Sheets

(51) Int. Cl.

| | |
|---|---|
| ***H04R 3/04*** | (2006.01) |
| ***H04R 5/04*** | (2006.01) |
| ***H04R 5/033*** | (2006.01) |
| ***H04R 5/027*** | (2006.01) |

(52) U.S. Cl.
CPC ..... *H04S 7/301* (2013.01); *H04S 7/307* (2013.01); *H04R 5/027* (2013.01); *H04R 5/033* (2013.01); *H04S 2400/01* (2013.01); *H04S 2400/11* (2013.01); *H04S 2420/01* (2013.01); *H04S 2420/07* (2013.01)

(56) References Cited

U.S. PATENT DOCUMENTS

| | | | | |
|---|---|---|---|---|
| 6,760,447 | B1 * | 7/2004 | Nelson | H04R 5/02 381/17 |
| 8,081,769 | B2 * | 12/2011 | Fukuda | H04R 3/02 381/71.6 |
| 2006/0045294 | A1 * | 3/2006 | Smyth | H04S 7/304 381/309 |
| 2009/0208027 | A1 * | 8/2009 | Fukuda | H04R 3/02 381/71.6 |
| 2011/0116639 | A1 * | 5/2011 | Yamada | G10L 19/008 381/17 |
| 2015/0180433 | A1 * | 6/2015 | Nakagawa | H03G 3/20 381/98 |
| 2017/0295445 | A1 * | 10/2017 | Christoph | H04S 7/306 |

* cited by examiner

OUT-OF-HEAD LOCALIZATION PROCESSING APPARATUS AND OUT-OF-HEAD LOCALIZATION PROCESSING METHOD

CROSS REFERENCE TO RELATED APPLICATION

This application is a continuation of PCT application number PCT/JP2016/003153 filed on Jul. 1, 2016 and is based upon and claims the benefit of priority from Japanese patent application number 2015-184223, filed on Sep. 17, 2015, the disclosure of which is incorporated herein in its entirety by reference.

BACKGROUND

The present disclosure relates to an out-of-head localization processing apparatus and an out-of-head localization processing method.

As one of the sound field reproduction techniques, there is an "out-of-head localization headphone technique" that generates a sound field as if sound is reproduced by speakers even when the sound is actually reproduced by headphones. The out-of-head localization headphone technique uses, for example, the head-related transfer characteristics of a listener (spatial transfer characteristics from 2ch virtual speakers placed in front of the listener to his/her left and right ears, respectively) and ear canal transfer characteristics of the listener (transfer characteristics from right and left diaphragms of headphones to the listener's ear canals, respectively).

In out-of-head localization reproduction, measurement signals (impulse sound etc.) output from two-channel (hereinafter referred to as ch) speakers are recorded by microphones placed in the listener's ears. Then, head-related transfer characteristics are calculated from impulse responses, and filters are created. The out-of-head localization reproduction can be achieved by convolving the created filters with 2ch music signals.

It is possible to accurately measure characteristics by disposing microphones in ears (preferably in entrances of ear canals) of a listener. However, measurement which is performed after disposing microphones at entrances of ear canals of a listener is complicated. Therefore, Patent Literature 1 (Japanese Unexamined Patent Application Publication No. 2002-135898) discloses a method for measuring transfer characteristics by using headphones equipped with built-in microphones.

In Patent Literature 1, coefficients are successively updated by using adaptive signal processing so that signals of microphones disposed on inner sides of the headphones have desired characteristics. By doing so, desired target characteristics can be obtained. Note that the target characteristics are, for example, transfer characteristics that are obtained near both ears when a center sound source is placed in front of a user.

SUMMARY

In Patent Literature 1, the positions in which the microphones attached to the headphones are disposed are important in order to make the expression (6) shown in paragraph [0059] of Patent Literature 1 hold. Specifically, it is necessary that left and right microphones are placed in positions identical to the microphones, which are attached to a listener near his/her ears, or to a dummy head used as a substitute for a listener. However, shapes of listeners' heads, which vary from one listener to another, are not identical to the shape of the dummy head. Therefore, deviations in the positions of the microphones are unavoidable. It is very difficult to reliably dispose microphones attached to headphones near ears. As a result, deviations in the positions, which differ from one listener to another, occur.

Sounds that a listener actually hears are received by his/her eardrums. Therefore, assuming that vibrations of sounds propagating through the ear canal are first-order vibrations, it is considered that signals of sounds that are received at an entrance of an ear canal are more accurate. Therefore, since the target characteristics disclosed in Patent Literature 1 are those of signals received in the places where microphones that can be attached to headphones are disposed, they lack accuracy. Further, adaptive control involves a large processing load. Therefore, it is desired to develop control that can be achieved at a lower cost and a simpler mechanism.

An out-of-head localization processing apparatus according to an aspect of an embodiment includes: headphones including left and right output units; left and right microphones attached to the left and right output units, respectively; a measurement unit configured to collect sounds output from the left and right output units by using the left and right microphones, respectively, and thereby measure left and right headphone transfer characteristics, respectively; an inverse-filter calculation unit configured to calculate inverse filters of the left and right headphone transfer characteristics, respectively, in a frequency domain; a correction unit configured to calculate correction filters by correcting the inverse filters in the frequency domain; a convolution calculation unit configured to perform convolution processing for reproduced signals by using spatial acoustic transfer characteristics; a filter unit configured to perform convolution processing for the reproduced signal, which has been subjected to the convolution processing in the convolution calculation unit, by using the correction filters; and an input unit configured to receive a user input for selecting an optimal correction pattern from among a plurality of correction patterns, in which the headphones output the reproduced signal into which the correction filters are convoluted, and the correction unit: corrects the inverse filters by using a predefined correction function in a first frequency band; corrects the inverse filters according to the correction pattern selected based on the user input in a second frequency band higher than the first frequency band; and corrects the correction filters to a predetermined value in a third frequency band higher than the second frequency band.

An out-of-head localization processing method according to an embodiment is an out-of-head localization processing method using an out-of-head localization processing apparatus, the out-of-head localization processing apparatus including: headphones including left and right output units; left and right microphones attached to the left and right output units, respectively; and an input unit configured to receive a user input for selecting an optimal correction pattern from among a plurality of correction patterns, the out-of-head localization processing method including: a step of collecting sounds output from the left and right output units by using the left and right microphones, respectively, and thereby measuring left and right headphone transfer characteristics, respectively; a step of calculating inverse filters of the left and right headphone transfer characteristics in a frequency domain; a step of correcting the inverse filters by using a plurality of correction patterns and thereby generating a plurality of correction filters corresponding the plurality of correction patterns in the frequency domain; a step of selecting an optimal correction pattern from among the plurality of correction patterns; a convolution step of performing convolution processing for reproduced signals by using spatial acoustic transfer characteristics; a step of performing convolution processing for the reproduced signals, into which spatial acoustic transfer characteristics are convoluted, by using the correction filters; and a step of outputting the reproduced signals, into which the correction filters are convoluted, from the headphones, in which in the step of generating the correction filters, the inverse filters are corrected by using a predefined correction function in a first frequency band; the inverse filters are corrected according to the correction pattern selected based on the user input in a second frequency band higher than the first frequency band; and the correction filters are corrected to a predetermined value in a third frequency band higher than the second frequency band.

According to the embodiment, it is possible to provide an out-of-head localization processing apparatus and an out-of-head localization processing method capable of appropriately performing out-of-head localization processing even when microphones attached to headphones are used.

DETAILED DESCRIPTION

Outline

Figure 1:
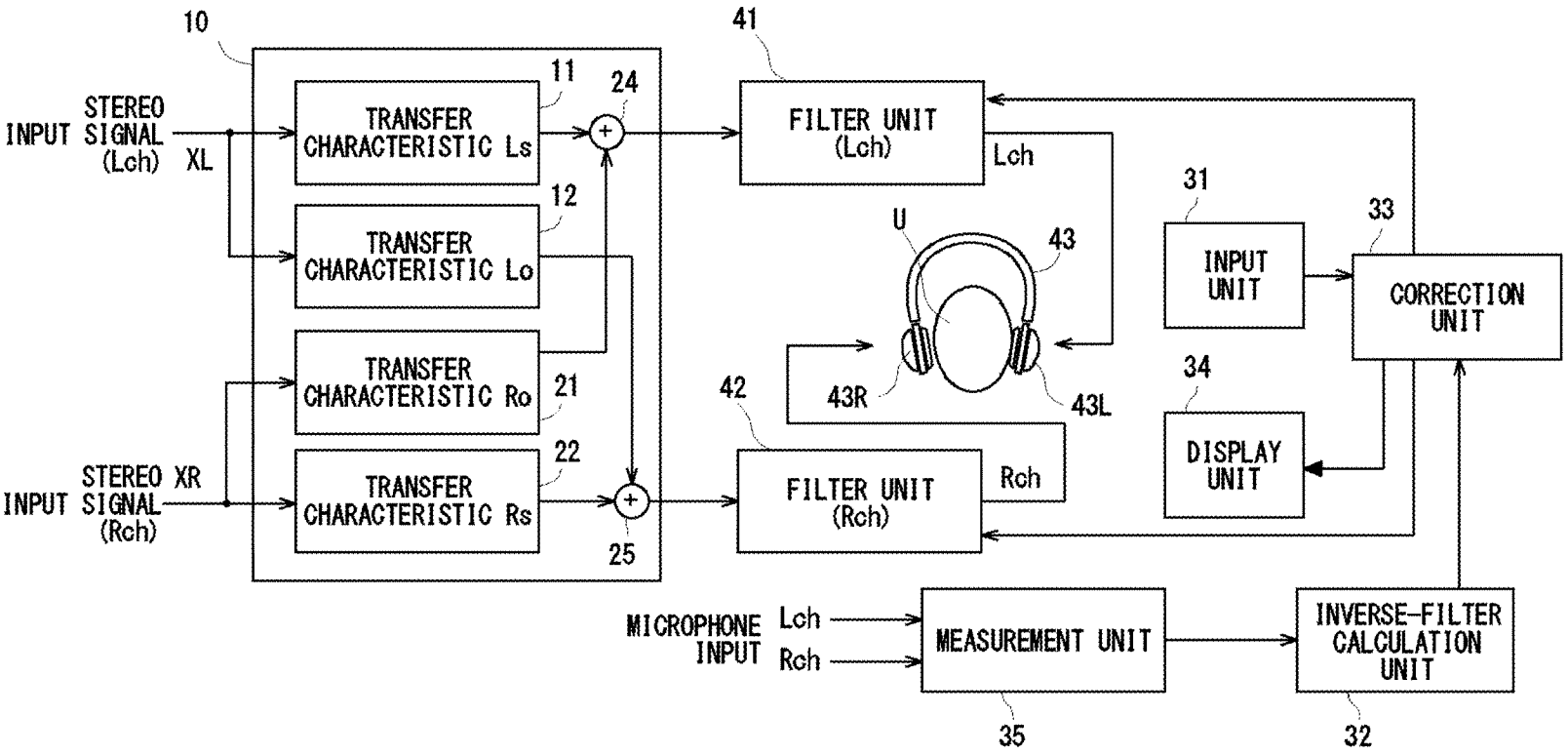
FIG. 1 is a block diagram showing an out-of-head localization processing apparatus according to an embodiment.

An outline of out-of-head localization processing according to an embodiment is explained. The out-of-head localization processing according to this embodiment is performed by using spatial acoustic transfer characteristics (also called spatial acoustic transfer functions) and ear canal transfer characteristics (also called ear canal transfer functions). In this embodiment, the out-of-head localization processing is performed by using the spatial acoustic transfer characteristics from speakers to ears of a listener and the ear canal transfer characteristics in a state in which the listener wears headphones.

As the spatial acoustic transfer characteristics, received-sound signals measured at entrances of ear canals of a listener himself/herself are preferably used. However, measurement which is performed after disposing microphones at entrances of ear canals of a listener himself/herself is complicated. Therefore, in this embodiment, a listener selects characteristics suitable for the listener himself/herself from among preset characteristics. The spatial acoustic transfer characteristics include transfer characteristics from stereo speakers to both ears.

Specifically, the spatial acoustic transfer characteristics include a transfer characteristic Ls from a left speaker to an entrance of an ear canal of a left ear, a transfer characteristic Lo from the left speaker to an entrance of an ear canal of a right ear, a transfer characteristic Ro from a right speaker to the entrance of the ear canal of the left ear and a transfer characteristic Rs from the right speaker to the entrance of the ear canal of the right ear. Further, transfer characteristics are measured in advance at entrances of ear canals of a plurality of listeners or dummy heads and categorized into a plurality of sets by a statistical analysis or the like. Each set of spatial acoustic transfer characteristics includes four transfer characteristics Ls, Lo, Ro and Rs. A plurality of sets of spatial acoustic transfer characteristics are prepared and a listener sets spatial acoustic transfer characteristics by selecting an appropriate set of spatial acoustic transfer characteristics from among these sets. Then, an out-of-head localization processing apparatus performs convolution processing by using the four transfer characteristics.

Regarding the ear canal transfer characteristics, in principle, it is desirable to use headphone transfer characteristics that are measured by microphones disposed at entrances of ear canals (hereinafter referred to as ear-microphone characteristics). However, measurement which is performed after disposing microphones at entrances of ear canals of a listener himself/herself is complicated. Therefore, in this embodiment, instead of using ear-microphone characteristics measured by microphones disposed at entrances of ear canals of a listener himself/herself, headphone transfer characteristics that are measured by microphones disposed in headphones (hereinafter referred to as built-in microphone characteristics) are used.

In this embodiment, inverse filters of built-in microphone characteristics that are measured by microphones disposed in headphones are corrected. Then, convolution processing is performed by using correction filters that are obtained by correcting the inverse filters of the built-in microphone characteristics.

For example, ear-microphone characteristics and built-in microphone characteristics are represented by A and B, respectively. The characteristics necessary for the out-of-head localization processing are inverse filters (1/A) of the ear-microphone characteristics A. However, the ear-microphone characteristics A cannot be measured unless microphones are disposed at entrances of ear canals. Therefore, in this embodiment, built-in microphone characteristics B are measured by microphones disposed in headphones.

Note that if a relation between the characteristics A and B of headphones is known in advance, it is possible to obtain the inverse filters (1/A). For example, it is possible to obtain inverse filters (1/A) by multiplying inverse filters (1/B) of measured built-in microphone characteristics B by values (B/A). Note that the values (B/A) are filters intrinsic to headphones. The values (B/A) are referred to as multiplication filters. In this embodiment, the inverse filters (1/B) of the built-in microphone characteristics B are corrected so that the inverse filters (1/B) are brought close to the inverse filters (1/A) of the ear-microphone characteristics A.

The multiplication filters (B/A) are similar irrespective of individual listeners in certain frequency bands and differ from one listener to another in other frequency bands. Therefore, a frequency domain is divided into a plurality of frequency bands and the method for correcting inverse filters (1/B) is changed for each of the frequency bands.

In this embodiment, when correction filters are obtained from inverse filters (1/B), amplitude values at frequencies in each frequency band (hereinafter expressed as frequency amplitude values) are controlled. Correction filters are generated by amplifying or attenuating frequency amplitude values of inverse filters (1/B).

Further, in this embodiment, a user performs an audibility test. Then, the user selects an optimal correction pattern from among a plurality of correction patterns according to a result of the audibility test. Correction filters corresponding to the selected optimal correction pattern are used.

Further, left and right correction patterns are determined according to a correlation between left and right built-in microphone characteristics B of a user. Specifically, a correlation coefficient between frequency-amplitude characteristics of built-in microphone characteristics B is obtained. When the correlation coefficient is equal to or larger than a threshold, left and right inverse filters are corrected by using the same correction pattern. When the correlation coefficient is smaller than the threshold, different correction patterns can be selected for the left and right inverse filters.

An out-of-head localization processing apparatus according to this embodiment includes an information processing apparatus such as a personal computer. Specifically, the out-of-head localization processing apparatus includes processing means such as a processor, storage means such as a memory or a hard disk drive, display means such as a liquid-crystal monitor, input means such as a touch panel, buttons, a keyboard, or a mouse, and output means such as headphones or earphones. Alternatively, the out-of-head localization processing apparatus may be a smartphone or a tablet PC (Personal Computer).

Out-of-Head Localization Processing Apparatus

Figure 2:
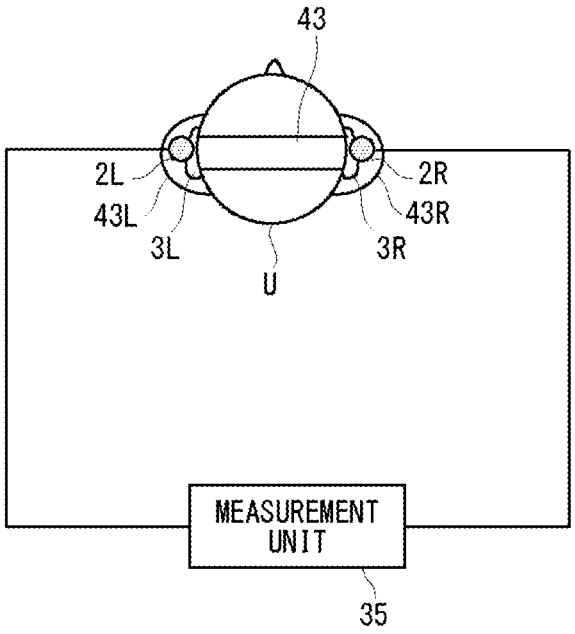
FIG. 2 is a diagram showing a configuration for measuring transfer characteristics of headphones.

An out-of-head localization processing apparatus and its processing method according to an embodiment are explained with reference to FIGS. 1 and 2. FIG. 1 is a block diagram showing a configuration of an out-of-head localization processing apparatus 100. FIG. 2 is a diagram showing a configuration for measuring built-in microphone characteristics B.

The out-of-head localization processing apparatus 100 reproduces a sound field for a user U wearing headphones 43. To that end, the out-of-head localization processing apparatus 100 performs out-of-head localization processing for stereo input signals XL and XR having a left channel (hereinafter expressed as an L-ch) and a right channel (hereinafter expressed as an R-ch). The stereo input signals XL and XR having the L-ch and the R-ch are reproduced music signals output from a CD (Compact Disc) player or the like. Note that the out-of-head localization processing apparatus 100 is not limited to an apparatus composed of a single physical entity. That is, part of the out-of-head localization processing may be performed in another apparatus. For example, part of the processing may be performed by a personal computer or the like and the remaining processing may be performed by a DSP (Digital Signal Processor) or the like disposed inside the headphones 43.

As shown in FIG. 1, the out-of-head localization processing apparatus 100 includes an out-of-head localization processing unit 10, an input unit 31, an inverse-filter calculation unit 32, a correction unit 33, a display unit 34, a measurement unit 35, a filter unit 41, a filter unit 42, and headphones 43.

The out-of-head localization processing unit 10 includes convolution calculation units 11, 12, 21 and 22. Each of the convolution calculation units 11, 12, 21 and 22 performs convolution processing using spatial acoustic transfer characteristics. Stereo input signals XL and XR output from a CD player or the like are input to the out-of-head localization processing unit 10. Spatial acoustic transfer characteristics are set in advance in the out-of-head localization processing unit 10. The out-of-head localization processing unit 10 convolutes spatial acoustic transfer characteristics into each of the stereo input signals XL and XR having the respective channels.

For example, a user U selects optimal spatial acoustic transfer characteristics from among a plurality of preset spatial acoustic transfer characteristics. The spatial acoustic transfer characteristics include a transfer characteristic Ls from a left speaker to an entrance of an ear canal of a left ear, a transfer characteristic Lo from the left speaker to an entrance of an ear canal of a right ear, a transfer characteristic Ro from a right speaker to the entrance of the ear canal of the left ear, and a transfer characteristic Rs from the right speaker to the entrance of the ear canal of the right ear. That is, the spatial acoustic transfer characteristics include four transfer characteristics Ls, Lo, Ro and Rs.

Then, the convolution calculation unit 11 convolutes the transfer characteristic Ls into the L-ch stereo input signal XL. The convolution calculation unit 11 outputs convolution calculation data to an adder 24. The convolution calculation unit 21 convolutes the transfer characteristic Ro into the R-ch stereo input signal XR. The convolution calculation unit 21 outputs convolution calculation data to the adder 24. The adder 24 adds the two convolution calculation data and outputs the resultant data to the filter unit 41.

The convolution calculation unit 12 convolutes the transfer characteristic Lo into the L-ch stereo input signal XL. The convolution calculation unit 12 outputs convolution calculation data to an adder 25. The convolution calculation unit 22 convolutes the transfer characteristic Rs into the R-ch stereo input signal XR. The convolution calculation unit 22 outputs convolution calculation data to the adder 25. The adder 25 adds the two convolution calculation data and outputs the resultant data to the filter unit 42.

A correction filter is set in each of the filter units 41 and 42. As described later, the correction filter is generated by the correction unit 33. That is, each of the filter units 41 and 42 stores the correction filter generated by the correction unit 33.

Each of the filter units 41 and 42 convolutes the correction filter into the reproduced signal that has been subjected to the processing in the out-of-head localization processing unit 10. The filter unit 41 convolutes the correction filter into the L-ch signal output from the adder 24. The L-ch signal, into which the correction filter has been convoluted by the filter unit 41, is output to a left output unit 43L of the headphones 43. Similarly, the filter unit 42 convolutes the correction filter into the R-ch signal output from the adder 25. The R-ch signal, into which the correction filter has been convoluted by the filter unit 42, is output to a right output unit 43R of the headphones 43.

The left output unit 43L of the headphones 43 outputs the L-ch signal with the correction filter convoluted therein toward the left ear of the user U. The right output unit 43R of the headphones 43 outputs the R-ch signal with the correction filter convoluted therein toward the right ear of the user U. When a user wears the headphones 43, the correction filters cancel out transfer characteristics between entrances of ear canals of the user and the speaker units of the headphones. By doing so, headphone transfer characteristics of the headphones 43 are corrected (cancelled out). As a result, an acoustic image of sounds that the user U hears is localized outside the head of the user U.

The display unit 34 includes a display device such as a liquid-crystal monitor. The display unit 34 displays a setting window or the like for setting correction filters.

The input unit 31 includes an input device such as a touch panel, buttons, a keyboard, or a mouse, and receives an input from the user U. Specifically, the input unit 31 receives an input through the setting window for setting correction filters.

In this embodiment, the correction filters are generated based on measurement results obtained by using the headphones 43. Measurement that is carried out to generate correction filters is explained hereinafter.

As shown in FIG. 2, the headphones 43 include left and right output units 43L and 43R. Each of the output units 43L and 43R includes a speaker unit. Further, sound-collecting microphones 2L and 2R are attached to the left and right output units 43L and 43R, respectively. Specifically, the output units 43L and 43R include their respective speakers and the microphones 2L and 2R are disposed slightly below the centers of the speakers. A headphone terminal of the output units 43L and 43R of the headphones 43 is connected to a stereo audio output terminal. The microphones 2L and 2R are connected to a stereo microphone input terminal. The microphone 2L collects sounds output from the output unit 43L. The microphone 2R collects sounds output from the output unit 43R.

As described above, the left and right microphones 2L and 2R collect sounds output from the left and right output units 43L and 43R, respectively. In this example, impulse response measurement is carried out by using the left and right output units 43L and 43R and the microphones 2L and 2R. Signals of sounds collected by the microphones 2L and 2R are output to the measurement unit 35. The measurement unit 35 measures left and right built-in microphone characteristics B based on the signals of sounds collected by the microphones 2L and 2R. As shown in FIG. 1, the measurement unit 35 outputs the measured built-in microphone characteristics B to the inverse-filter calculation unit 32.

The inverse-filter calculation unit 32 calculates inverse characteristics of the built-in microphone characteristics B measured by the measurement unit 35 as inverse filters (1/B). The inverse-filter calculation unit 32 calculates a left inverse filter based on the signal of sound collected by the microphone 2L. The inverse-filter calculation unit 32 calculates a right inverse filter based on the signal of sound collected by the microphone 2R. As described above, the inverse-filter calculation unit 32 calculates the left and right inverse filters.

As described previously, it is desirable to dispose the microphones 2L and 2R at entrances of ear canals in order to cancel out the transfer characteristics between the entrances of the ear canals and the speaker units of the headphones. However, when the microphones 2L and 2R disposed in the headphones 43 are used, it is very difficult to dispose the microphones 2L and 2R at the entrances of the ear canals. Therefore, in this embodiment, in order to obtain inverse filters of ear-microphone characteristics based on measurement results of built-in microphone characteristics, inverse filters of the built-in microphone characteristics are corrected.

The role of the correction filters is to flatten frequency-amplitude characteristics at entrances of ear canals. That is, the role is to cancel out headphone transfer characteristics and thereby provide target characteristics (specifically, head-related transfer functions (HRTF5), free-space transfer functions).

Frequency-Amplitude Characteristic

Corrections made to inverse filters (1/B) of built-in microphone characteristics B are explained hereinafter by using data.

Figure 3:
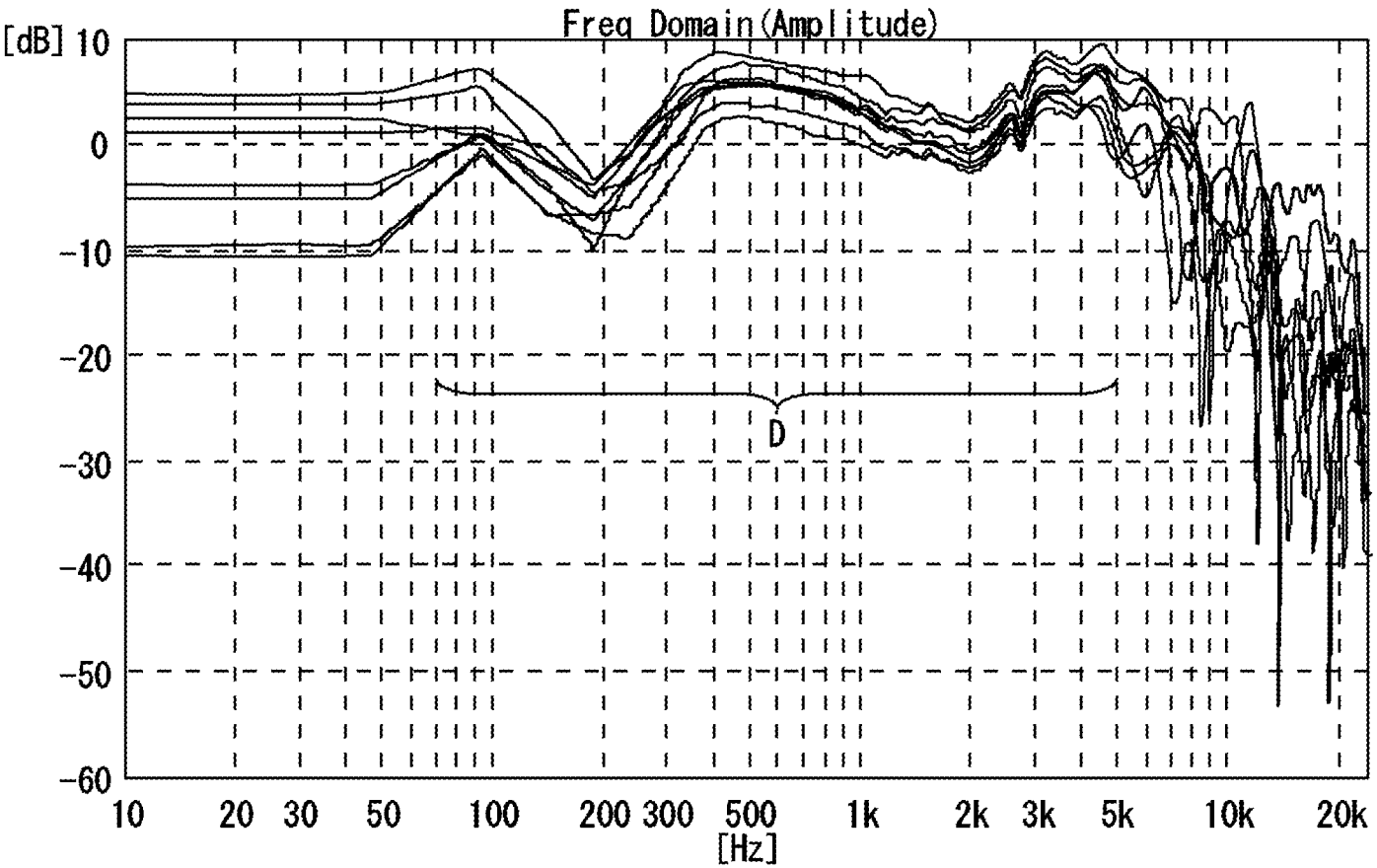
FIG. 3 is a graph showing measurement results of characteristics of an ear-microphone in a left ear.
Figure 4:
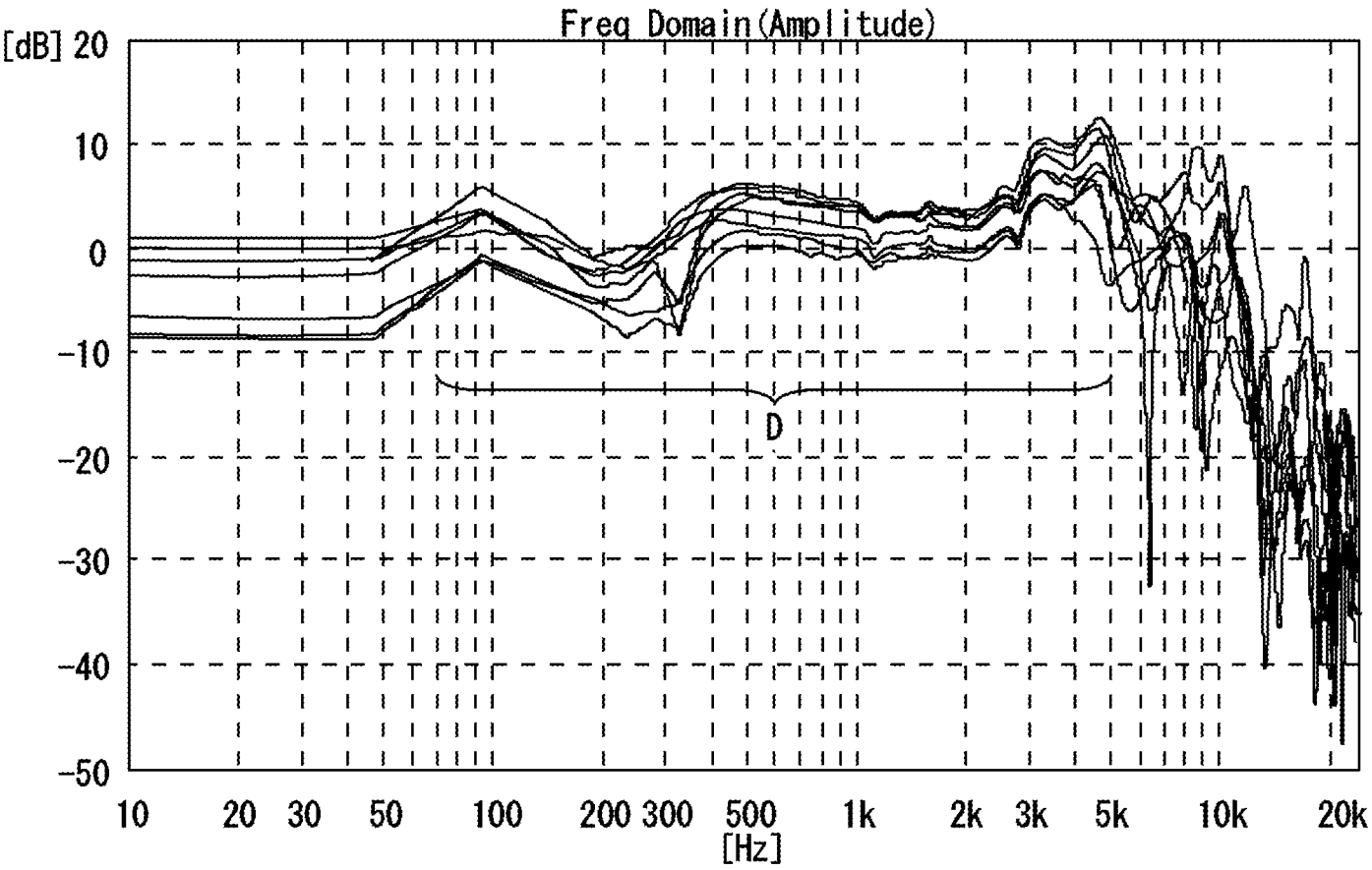
FIG. 4 is a graph showing measurement results of characteristics of an ear-microphone in a right ear.
Figure 5:
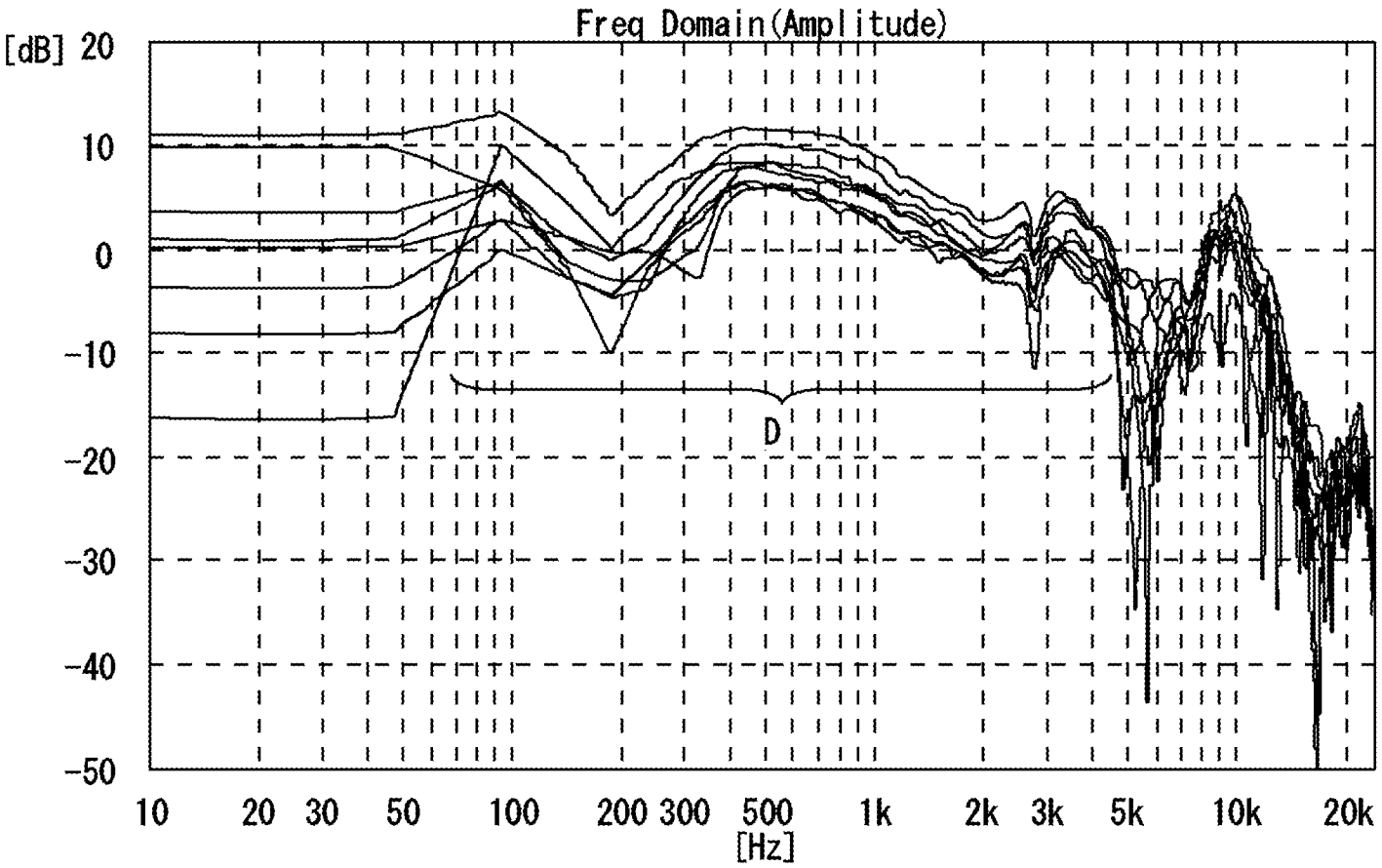
FIG. 5 is a graph showing measurement results of characteristics of a built-in microphone in a left ear.
Figure 6:
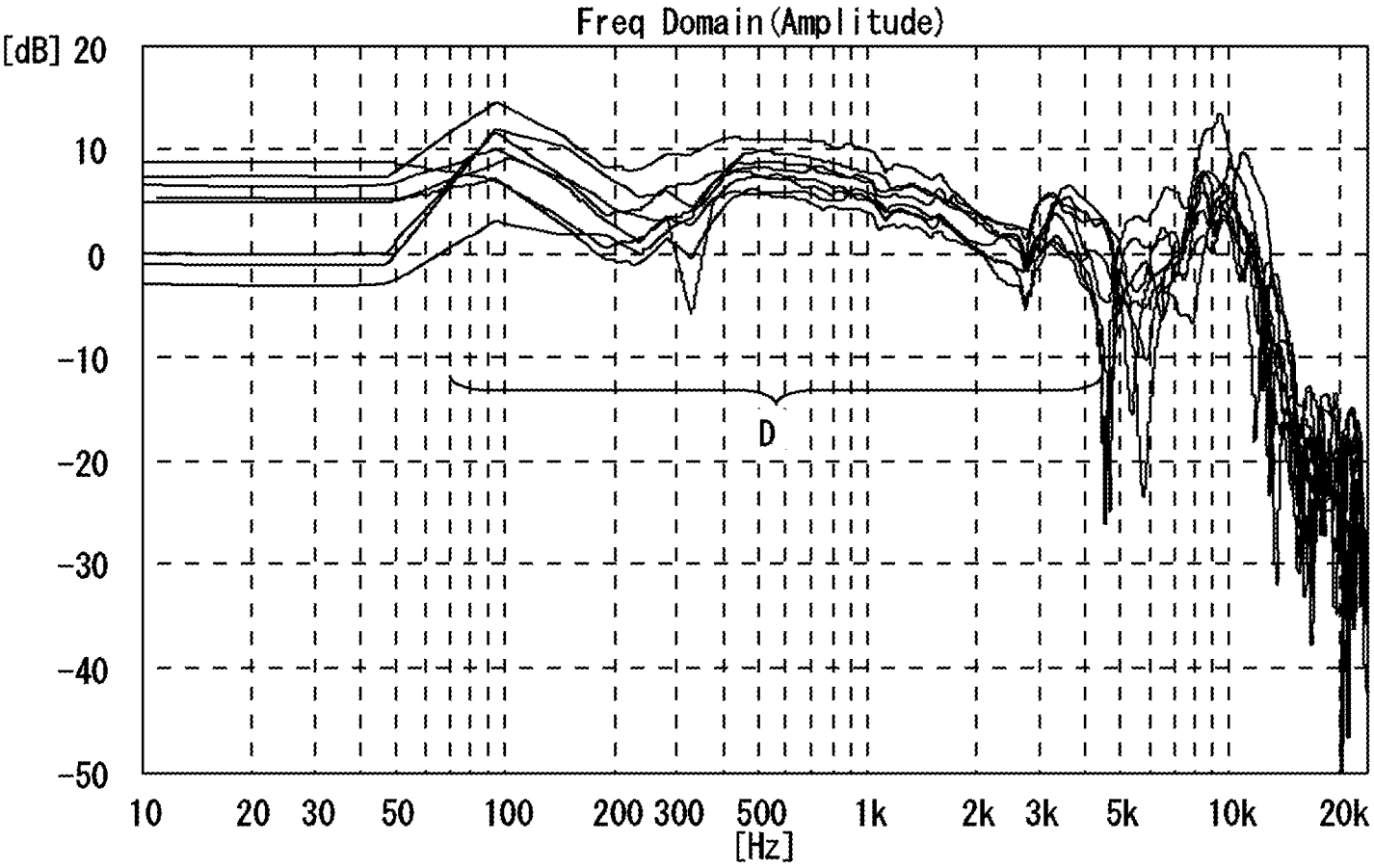
FIG. 6 is a graph showing measurement results of characteristics of a built-in microphone in a right ear.

FIGS. 3 and 4 show ear-microphone characteristics A measured by microphones disposed near left and right ears, respectively. Further, FIGS. 5 and 6 show built-in microphone characteristics B measured by the microphones 2L and 2R disposed in the headphones 43. FIGS. 3 to 6 show frequency-amplitude characteristics that are measured in a state in which listeners wear the same headphones 43. Further, the measurement results shown in FIGS. 3 and 4 and those shown in FIGS. 5 and 6 are obtained under the same conditions, except for the positions of the microphones. Note that FIGS. 3 and 5 show frequency-amplitude characteristics on the left-ear side and FIGS. 4 and 6 show frequency-amplitude characteristics on the right-ear side. Each of FIGS. 3 to 6 shows measurement results for the same eight listeners.

In the measurement results shown in FIGS. 3 to 6, they exhibit similar frequency-amplitude characteristics irrespective of individual listeners in a frequency range up to 5 kHz (see a frequency band D in each of FIGS. 3 to 6). That is, built-in microphone characteristics B of the left ear are similar to each other irrespective of individual listeners in the frequency range up to 5 kHz, and built-in microphone characteristics B of the right ear are similar to each other irrespective of individual listeners in the frequency range up to 5 kHz. Similarly, ear-microphone characteristics A of the left ear are similar to each other irrespective of individual listeners in the frequency range up to 5 kHz, and ear-microphone characteristics A of the right ear are similar to each other irrespective of individual listeners in the frequency range up to 5 kHz. Note that the built-in microphone characteristics B are not the same as the ear-microphone characteristics A because of the difference of the positions of the microphones. In the case of the headphones 43 used in the measurement, the characteristics are similar in the frequency range up to 5 kHz. However, for either of the built-in microphone characteristics B and the ear-microphone characteristics A, the frequency range in which the characteristics are similar changes according to the shape of the headphones 43. That is, the frequency range in which the characteristics are similar is determined for each shape of the headphones 43.

Meanwhile, in a frequency range equal to or higher than 5 kHz, each of the built-in microphone characteristics B and the ear-microphone characteristics A vary according to the individual listener. That is, the built-in microphone characteristics B in the frequency range equal to or higher than 5 kHz vary from one individual listener to another. Similarly, the ear-microphone characteristics A in the frequency range equal to or higher than 5 kHz vary from one individual listener to another.

When the inverse filters of the ear-microphone characteristics are compared with the inverse filters of the built-in microphone characteristics in a frequency range of about 5 kHz to about 12 kHz, the following characteristic patterns become evident.

(1) Shapes and levels of frequency-amplitude characteristics are similar.
(2) Although shapes of frequency-amplitude characteristics are similar, inverse filters of the built-in microphone characteristics are lower than inverse filters of the ear-microphone characteristics by about 10 dB.
(3) Inverse filters of the built-in microphone characteristics and inverse filters of the ear-microphone characteristics have roughly an inverse-characteristic relation therebetween.
(4) Shapes of the frequency-amplitude characteristics are dissimilar and inverse filters of the ear-microphone characteristics are roughly flat.

Figure 7:
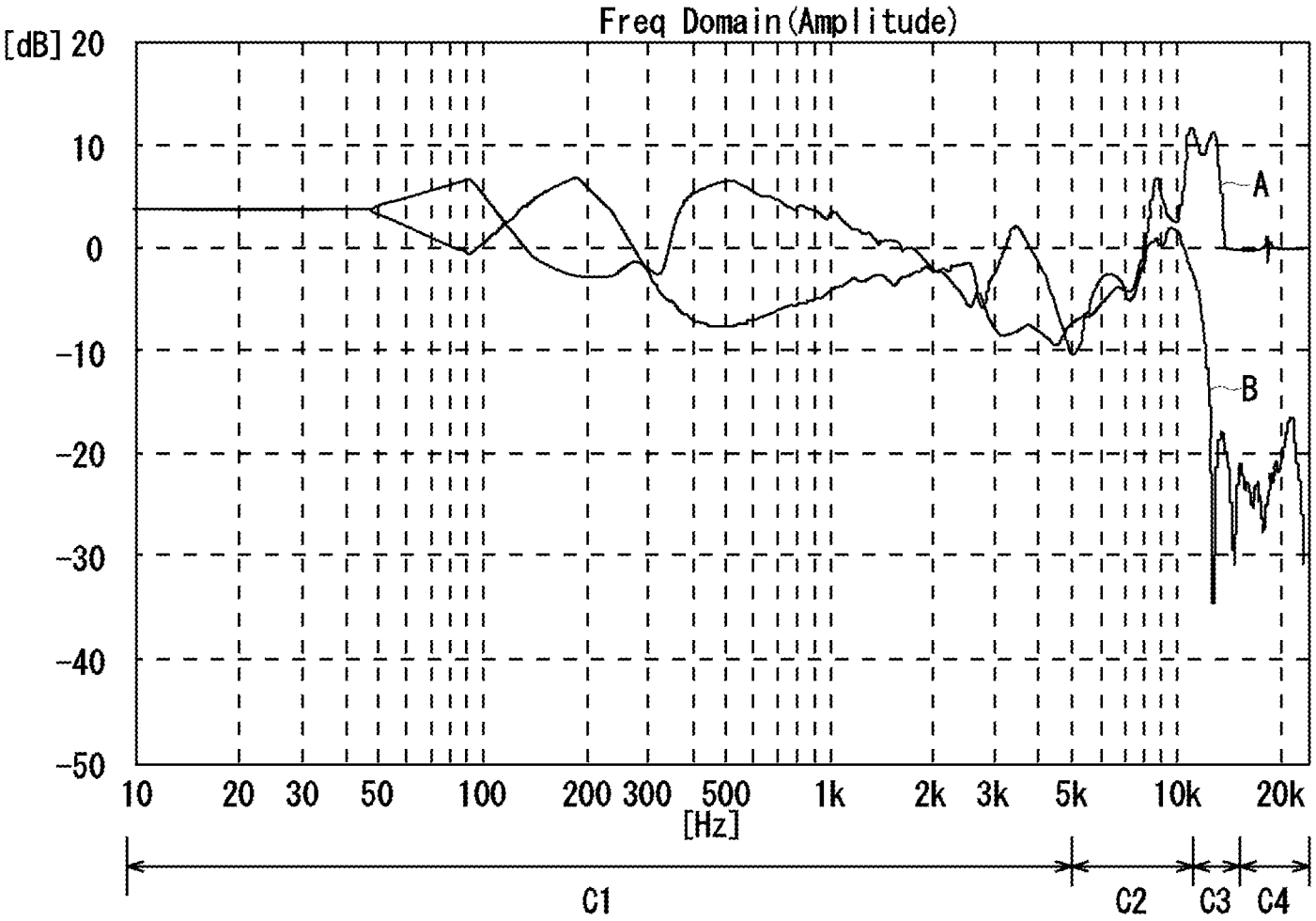
FIG. 7 is a graph showing a pattern (1) of frequency-amplitude characteristics in a second frequency band.
Figure 8:
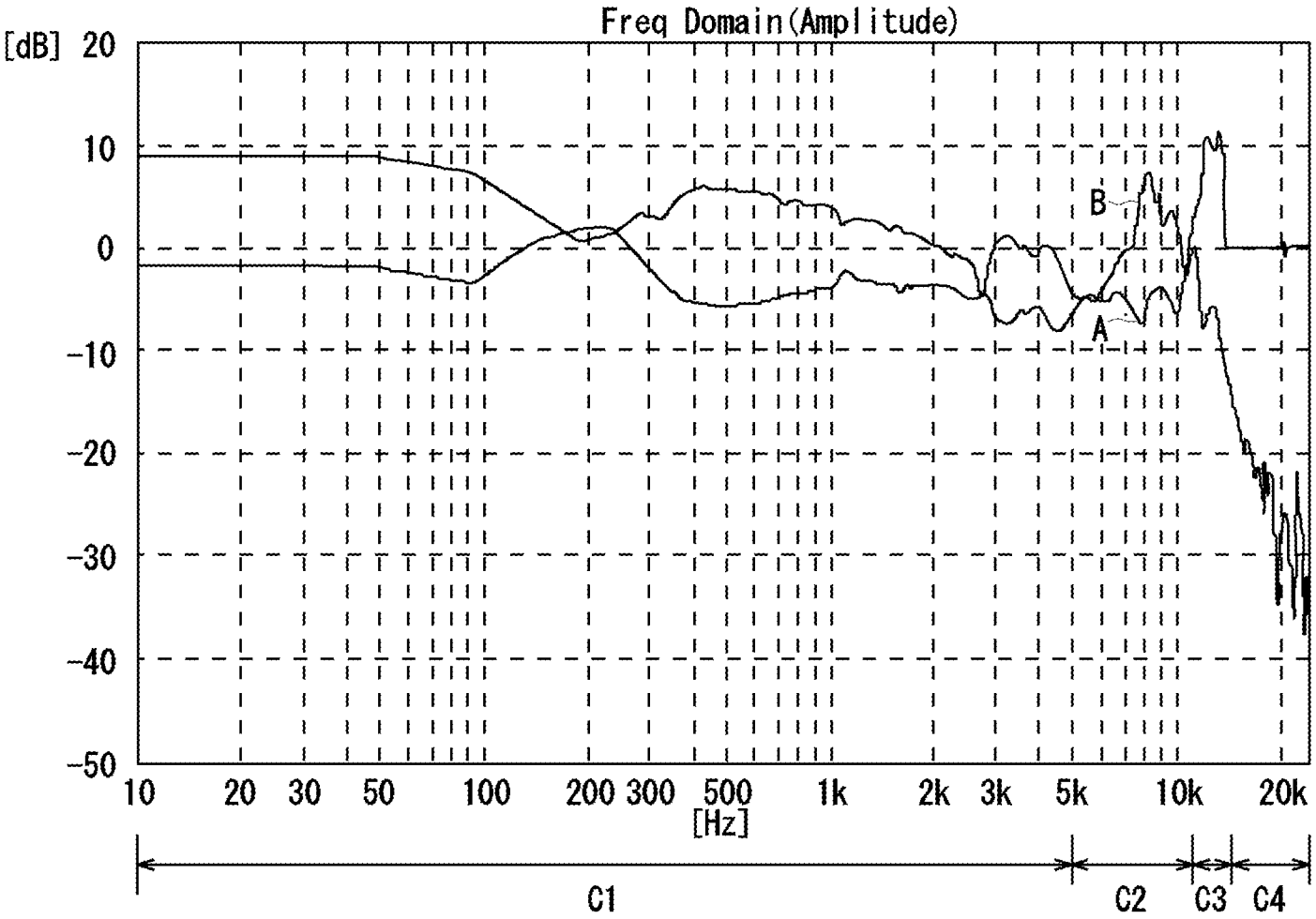
FIG. 8 is a graph showing a pattern (4) of frequency-amplitude characteristics in the second frequency band.
Figure 9:
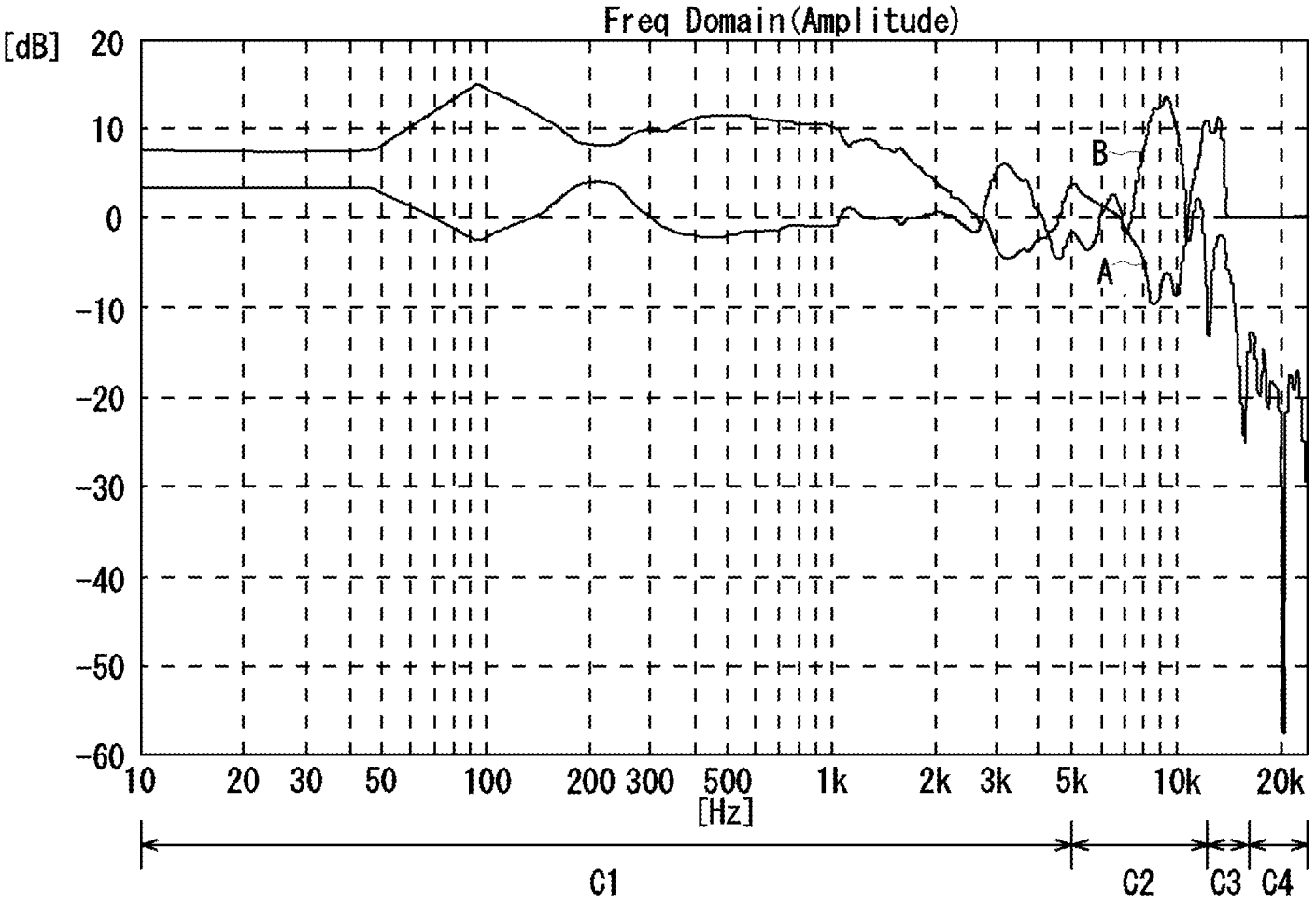
FIG. 9 is a graph showing a pattern (3) of frequency-amplitude characteristics in the second frequency band.

FIG. 7 shows an example of frequency-amplitude characteristics in the pattern (1). FIG. 8 shows an example of frequency-amplitude characteristics in the pattern (4). FIG. 9 shows an example of frequency-amplitude characteristics in the pattern (3).

From FIGS. 7 to 9, it can be understood that inverse filters of the built-in microphone characteristics are higher by about 10 dB in a frequency range of 12 kHz to 14 kHz.

The measurement unit 35 measures built-in microphone characteristics B for the user U by using the microphones 2L and 2R disposed in the headphones 43. Then, the correction unit 33 can obtain inverse filters (1/A) of the ear-microphone characteristics A by multiplying inverse filters (1/B) of the built-in microphone characteristics B by multiplication filters (B/A) intrinsic to the headphones.

Figure 10:
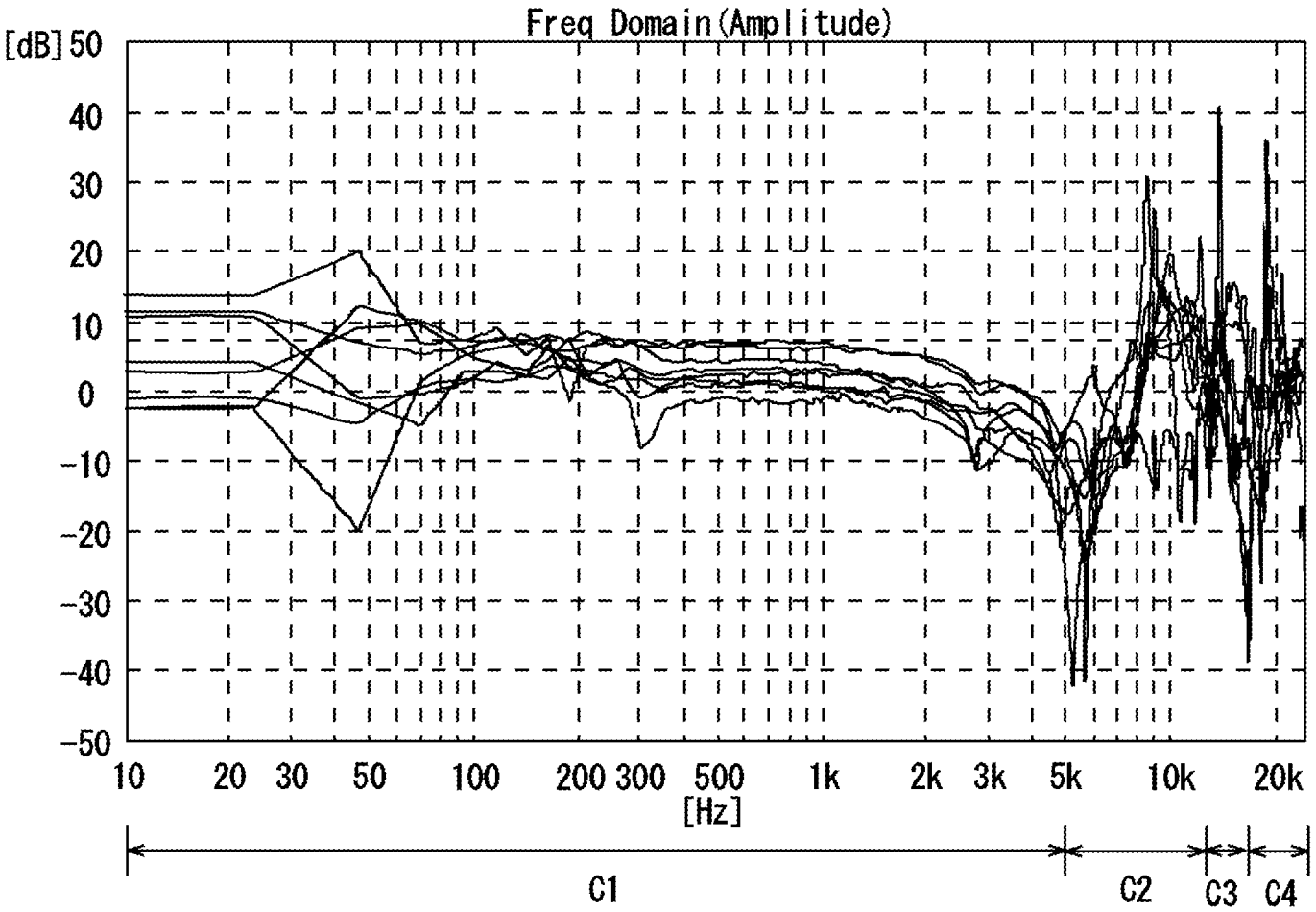
FIG. 10 is a graph showing frequency-amplitude characteristics of a multiplication filter for a left ear.
Figure 11:
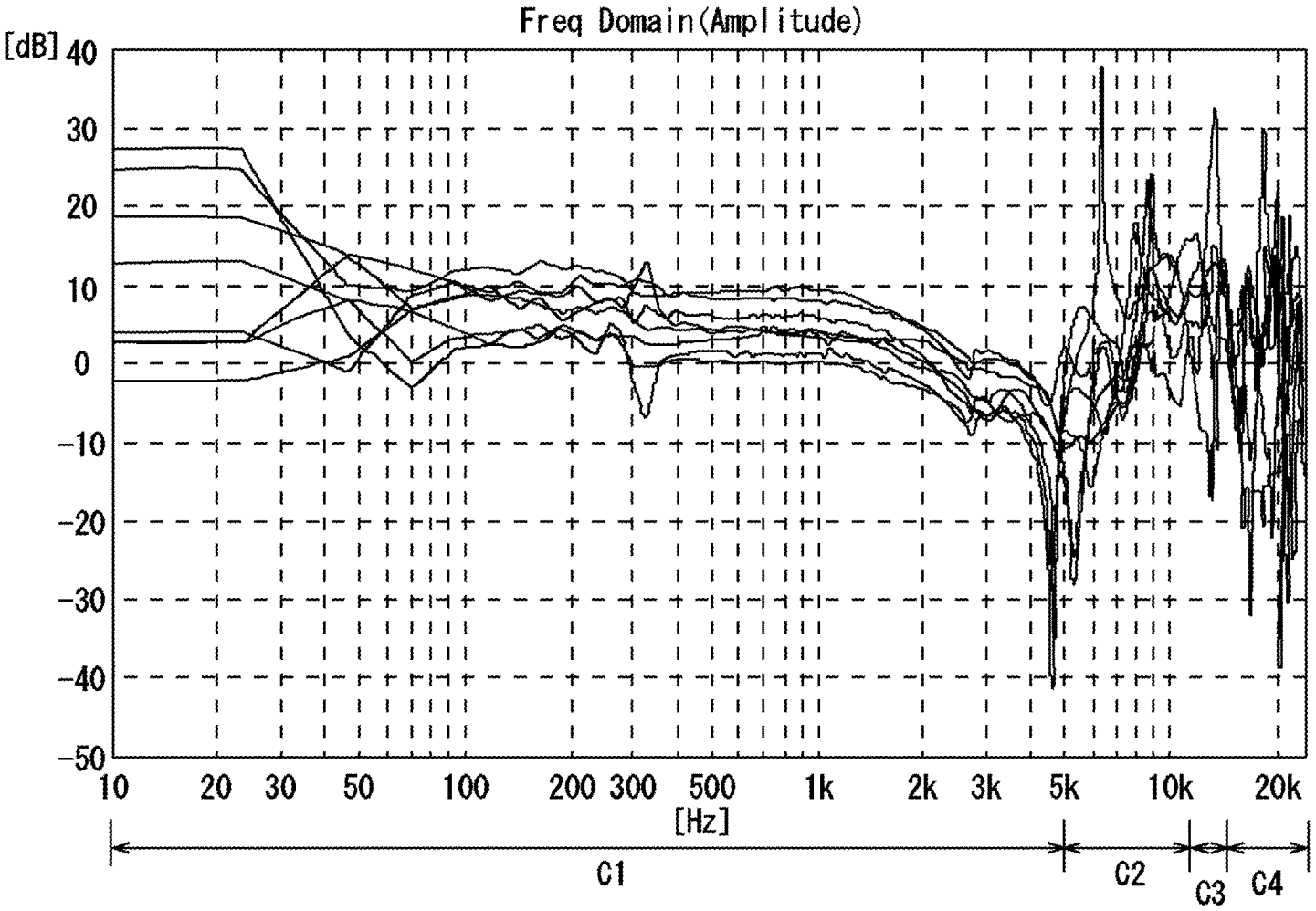
FIG. 11 is a graph showing frequency-amplitude characteristics of a multiplication filter fora right ear.

FIGS. 10 and 11 show multiplication filters (B/A). FIG. 10 shows multiplication filters (B/A) for a left ear and FIG. 11 shows multiplication filters (B/A) for a right ear. The multiplication filters shown in FIGS. 10 and 11 are calculated based on the measurement results shown in FIGS. 3 to 6.

In reality, it is very difficult to disposes microphones near ears by using headphones equipped with built-in microphones and hence it is impossible to measure multiplication filters A. Therefore, the correction unit 33 corrects inverse filters (1/B) by controlling amplitudes of the inverse filters (1/B) so that they become inverse filters (1/A). That is, the correction unit 33 calculates correction filters by amplifying or attenuating frequency amplitude values of inverse filters (1/B) of the built-in microphone characteristics B. As described above, the correction method is changed for each frequency band because the characteristics of the multiplication filters (B/A) vary for each frequency band. The method for correcting inverse filters (1/B) is described later.

Out-of-Head Localization Processing Method

Figure 12:
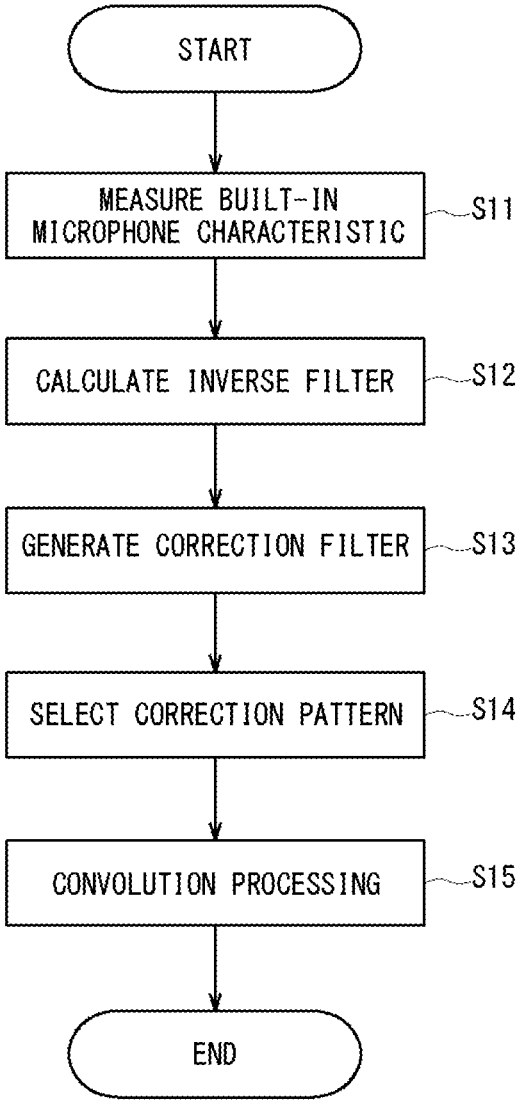
FIG. 12 is a flowchart showing an out-of-head localization processing method.

Next, an out-of-head localization processing method using correction filters is explained with reference to FIG. 12. FIG. 12 is a flowchart showing an out-of-head localization processing method using correction filters.

Firstly, the measurement unit 35 measures built-in microphone characteristics B (S11). The measurement unit 35 measures built-in microphone characteristics B of the user U by performing impulse response measurement. Specifically, the measurement unit 35 outputs impulse sounds from the left and right output units 43L and 43R of the headphones 43 and the microphones 2L and 2R collect the impulse sounds. Note that when the headphones 43 are closed-type headphones, built-in microphone characteristics B of a user U can be obtained by simultaneously generating left and right impulse sounds. When the headphones 43 are opened-type headphones, there is a possibility that part of the sound leaks from the left output unit 43L and collected by the right microphone 2R. This phenomenon is called crosstalk transfer characteristics of the headphones 43. When the crosstalk transfer characteristics are smaller than built-in microphone characteristics B by at least 30 dB, the crosstalk transfer characteristics can be ignored.

In this example, the measurement unit 35 calculates built-in microphone characteristics B in a frequency domain by performing a discrete Fourier transform (DFT) on built-in microphone characteristics B in a time domain. In this way, it is possible to obtain amplitude characteristics (an amplitude spectrum) and phase characteristics (a phase spectrum) in the frequency domain. Note that each transform process between the frequency domain and the time domain in the present disclosure is not limited to the DFT. That is, various transform processes such as an FFT and a DCT can be used.

The inverse-filter calculation unit 32 calculates inverse filters (1/B) of built-in microphone characteristics B (S12). Specifically, the inverse-filter calculation unit 32 calculates inverse characteristics of built-in microphone characteristics B as inverse filters (1/B).

Next, the correction unit 33 generates correction filters by correcting the inverse filters (1/B) (S13). Note that a plurality of correction patterns are set in advance in the correction unit 33. Further, the correction unit 33 generates correction filters for each of the plurality of correction patterns. The correction unit 33 generates left and right correction filters for each correction pattern. For example, when there are first to third correction patterns, the correction unit 33 generates three left correction filters and three right correction filters, i.e., generates six correction filters in total.

Specifically, the correction unit 33 controls amplitudes of the inverse filters (1/B) without changing phases thereof. Then, the correction unit 33 calculates correction filters by performing an inverse discrete Fourier transform (IDFT) for the phase characteristics and the amplitude-controlled amplitude characteristics. Note that details of the method for generating correction filters are described later.

Then, the user U performs an audibility test and thereby selects an optimal correction pattern (S14). For example, the user U hears audibility-test signals into which the first to third correction patterns are convoluted. Specifically, the filter units 41 and 42 convolute correction filters in the first to third correction patterns into white noises. Then, the user U hears the white noises into which the correction filters are convoluted by using the headphones 43.

The user U selects an optimal correction pattern based on sound quality of the white noises. The optimal correction pattern is selected according to a user input that is entered when the audibility test for the user is performed. Note that the role of the correction filters is to flatten frequency-amplitude characteristics at the positions of the microphones. That is, the role of the correction filters is to cancel out headphone transfer characteristics and thereby provide target characteristics (specifically, head-related transfer functions (HRTFs), free-space transfer functions). In reality, human ears hear sounds according to the equal-loudness contour and it is preferable to select a correction pattern in which there is no peculiarity in sound quality (i.e., there is no prominent frequency). Note that details of the method for selecting correction patterns are described later.

Then, convolution processing is performed by using correction filters according to the correction pattern selected by the user (S15). Specifically, the convolution calculation unit 21 performs convolution by using spatial acoustic transfer characteristics (Ls, Lo, Ro and Rs) and the filter units 41 and 42 perform convolution processing by using correction filters. In this way, since the spatial acoustic transfer characteristics and the correction filters are convoluted into the reproduced signals, out-of-head localization processing can be appropriately performed.

Since there is no need to dispose microphones at entrances of ear canals, correction filters can be easily calculated. That is, it is possible to generate inverse filters and correction filters by using built-in microphone characteristics B measured by the microphones 2L and 2R disposed in the headphones 43. Therefore, even when the microphones 2L and 2R attached to the headphones 43 are used, out-of-head localization processing can be appropriately performed. In other words, since there is no need to dispose microphones at entrances of ear canals, correction filters can be easily generated. Further, unlike Patent Literature 1, there is no need to perform adaptive control and hence the cost can be reduced.

Correction Filter and Correction Pattern

As described above, the difference between ear-microphone characteristics A and built-in microphone characteristics B varies for each frequency band. Therefore, the method for correcting built-in microphone characteristics B is changed for each frequency band. For example, in a frequency band up to 5 kHz (hereinafter referred to as a first frequency band), frequency amplitude values of built-in microphone characteristics B are corrected by using correction functions that are common to all the users. In a frequency band from 5 kHz to 12 kHz (hereinafter referred to as a second frequency band) in which individual variations are large, frequency amplitude values are divided into a plurality of patterns and they are corrected according to the patterns. For example, a user selects an optimal correction pattern according to his/her audibility test. In a frequency band from 12 kHz to 14 kHz (hereinafter referred to as a third frequency band), frequency amplitude values are set to a constant value (e.g., 10 dB). Note that this constant value is determined for each headphone. Further, in a frequency band equal to or higher than 14 kHz (hereinafter referred to as a fourth frequency band), frequency amplitude values are set to 0 dB.

In the second frequency band, frequency amplitude values are divided into a plurality of correction patterns. Correction patterns are explained hereinafter. An example in which frequency amplitude values are divided into first to third correction patterns is explained hereinafter.

In the first correction pattern, inverse filters (1/B) of built-in microphone characteristics B are used as they are as correction filters. The first correction pattern corresponds to the above-described pattern (1). That is, in the pattern (1), since shapes and levels of frequency-amplitude characteristics are similar to each other, inverse filters (1/B) of built-in microphone characteristics B can be used as they are as correction filters.

In the second correction pattern, frequency amplitude values of correction filters are set to constant values as in the case of a later-described specific example. In this example, frequency amplitude values in the second frequency band are set to 0 dB. Note that frequency amplitude values are not necessarily set to 0 dB, but may be set to arbitrary values.

In the third correction patterns, frequency amplitude values of inverse filters (1/B) are amplified or attenuated. That is, the correction unit 33 shifts levels of frequency amplitude values of inverse filters (1/B) so that the frequency amplitude values become continuous over each frequency band. For example, frequency amplitude values of inverse filters (1/B) in the second frequency band are increased or decreased by a certain value and used as frequency amplitude values of correction filters.

As described above, the user U performs an audibility test and thereby selects an optimal correction pattern from among the first to third correction patterns. Then, correction filters corresponding to the selected correction pattern are convoluted into the reproduced signals.

A specific example of the method for generating correction filters is explained hereinafter. In the following explanation, an example of the generation method in which the second correction pattern is selected is shown. In the following explanation: i is a frequency index in a DFT; freq[i] is a frequency (Hz) in a frequency index i; tmp_dB[i] is a sound pressure level (dB) at a frequency of a correction filter in a frequency index i; and amp_dB[i] is a sound pressure level (dB) at the frequency of an inverse filter (1/B) of measured built-in microphone characteristics. Further, numerical values and correction functions in the below-shown correction example are merely examples in headphones used for measurement, and the present disclosure is not limited to the below-shown specific numerical values and correction functions.

(I) When polarities of phases of left and right built-in microphone characteristics in low frequencies are opposite to each other, the left and right phase values are made to conform to each other. In this embodiment, left and right phase values are made to conform to each other according to left and right phases at the lowest frequency that can be analyzed by the DFT.

First Frequency Band (Lowest Frequency to 5 kHz)

(II) In a frequency range from the lowest frequency to 1 kHz, the frequency amplitude value tmp_dB[i] of the correction filter is set to a constant value amplk_dB. Note that the constant value amplk_dB is a frequency amplitude value of the inverse filter (1/B) of the built-in microphone characteristic at 1 kHz. Further, the lowest frequency is, for example, 10 Hz.

(III) In a frequency range from 1 kHz to 2 kHz, frequency amplitude values are set to values expressed by the below-shown correction expression (1).

$$\text{tmp_dB}[i]=\text{amp_dB}[i]+\text{freq}[i]*(-0.0035)+3.5 \quad (1)$$

(IV) In a frequency range from 2 kHz to 4 kHz, frequency amplitude values are set to values expressed by the below-shown correction expression (2).

$$\text{tmp_dB}[i]=\text{amp_dB}[i]+\text{freq}[i]*(-0.002)+0.5 \quad (2)$$

(V) In a frequency range from 4 kHz to 5 kHz, frequency amplitude values are set to values expressed by the below-shown correction expression (3).

$$\text{tmp_dB}[i]=\text{amp_dB}[i]+\text{freq}[i]*(-3.5/800)+10 \quad (3)$$

Second Frequency Band (5 kHz to 12 kHz)

(VI) In the second frequency band, the frequency amplitude value tmp_dB[i] is set to a constant value. In the second frequency band, the frequency amplitude value tmp_dB[i] is set to 0 dB (tmp_dB[i]=0 dB).

Third Frequency Band (12 kHz to 14 kHz)

(VII) In the third frequency band, the frequency amplitude value tmp_dB[i] is set to a constant value. In the third frequency band, the frequency amplitude value tmp_dB[i] is set to 10 dB (tmp_dB[i]=10 dB).

Fourth Frequency Band (14 kHz to Highest Frequency)

(VIII) In the fourth frequency band, the frequency amplitude value tmp_dB[i] is set to a constant value. In the fourth frequency band, the frequency amplitude value tmp_dB[i] is set to 0 dB (tmp_dB[i]=0 dB).

As described above, the correction unit 33 generates correction filters based on inverse filters (1/B). In the first frequency band, frequency amplitude values of built-in microphone characteristics are corrected by using correction functions. The correction functions are intrinsic to the headphones and are common to all the users. Therefore, the same correction functions are set for the same type (e.g., shape) of headphones. In the second frequency band, corrections are made according to the correction pattern. In each of the third and fourth frequency bands, frequency amplitude values of correction filters are set to a constant value.

Figure 13:
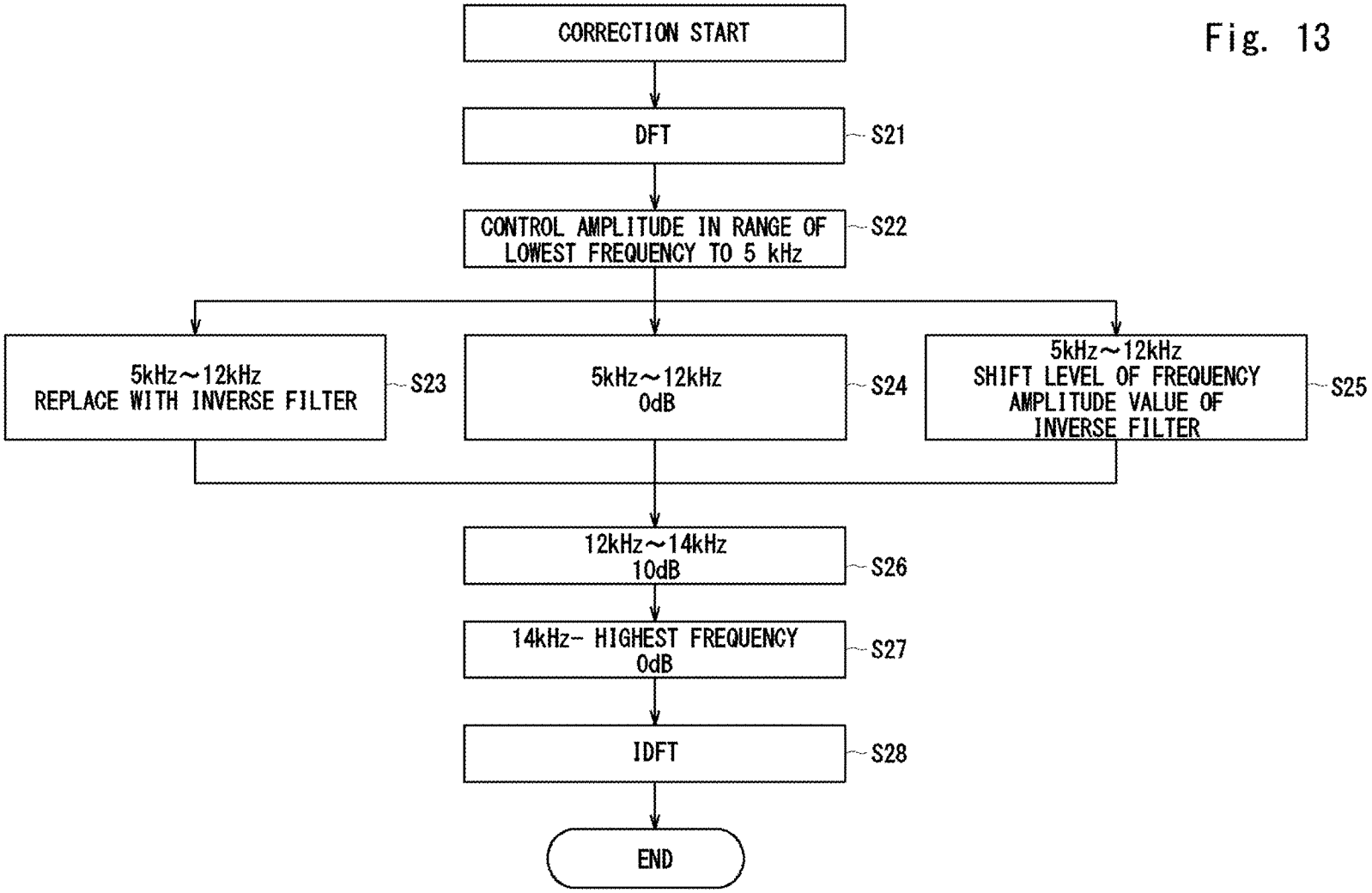
FIG. 13 is a flowchart showing details of a correction filter generation step.

Next, a step for generating correction filters (S13) is explained in detail with reference to FIG. 13. FIG. 13 is a flowchart showing details of the step for generating correction filters.

Firstly, amplitude characteristics and phase characteristics in a frequency domain are calculated by performing DFT processing on inverse filters (1/B) (S21). Next, amplitudes in the first frequency band (lowest frequency to 5 kHz) are controlled (S22). The lowest frequency is, for example, 10 Hz. As described above, in the first frequency band, frequency amplitude values are amplified or attenuated according to correction functions that are common to all the users. Note that the correction functions vary for each headphone. That is, different correction functions are used for different types (e.g., shapes) of headphones, whereas the same correction functions are used for the same type (e.g., shape) of headphones. Therefore, correction functions may be set for each type of headphones. Note that regarding the correction functions, approximate expressions may be calculated by using straight lines or arbitrary curved lines from frequency characteristics like the one shown in FIG. 10.

Next, amplitudes in the second frequency band (5 kHz to 12 kHz) are controlled according to the first to third correction patterns (S23 to S25). In the first correction pattern, frequency amplitude values of correction filters in a frequency range of 5 kHz to 12 kHz are replaced by inverse filters (1/B) of built-in microphone characteristics B in the frequency range of 5 kHz to 12 kHz (S23). That is, frequency amplitude values of inverse filters (1/B) of built-in microphone characteristics B are used as they are as frequency amplitude values of correction filters.

In the second correction pattern, frequency amplitude values in the frequency range of 5 kHz to 12 kHz are set to 0 dB (S24). In the third correction pattern, levels of frequency amplitude values of inverse filters (1/B) in the frequency range of 5 kHz to 12 kHz are shifted so that the frequency amplitude values become continuous over each frequency band (S25). For example, frequency amplitude values of inverse filters (1/B) are increased or decreased by a certain value and used as frequency amplitude values of correction filters.

Next, frequency amplitude values in the third frequency band (12 kHz to 14 kHz) are set to 10 dB (S26). Frequency amplitude values in the fourth frequency band (14 kHz to highest frequency) are set to 0 dB (S27). Then, an inverse discrete Fourier transform (IDFT) is performed (S28). In this way, correction filters can be obtained for each correction pattern. Note that frequency-phase characteristics of inverse filters (1/B) can be used as they are as frequency-phase characteristics used in the inverse discrete Fourier transform.

By performing the processing shown in FIG. 13 for each of left and right sides, left and right correction filters are generated. Specifically, since there are three correction patterns for each of left and right sides, the correction unit 33 generates six correction filters in total. A correction filter corresponding to the first correction pattern is referred to as a first correction filter hereinafter. Correction filters corresponding to the second and third correction patterns are referred to as second and third correction filters, respectively.

Selection of Correction Pattern

Figure 14:
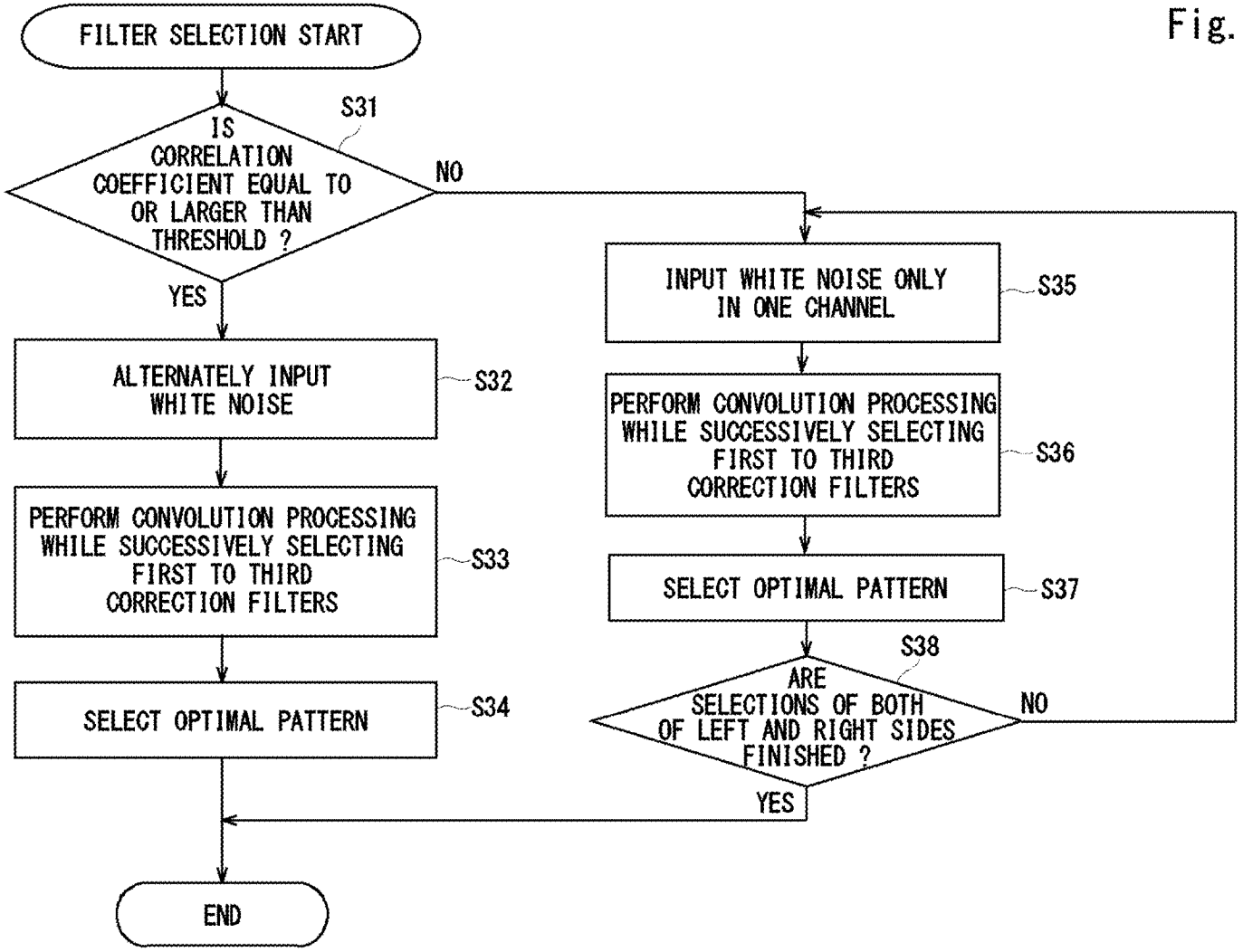
FIG. 14 is a flowchart showing details of a correction filter selection step.
Figure 15:
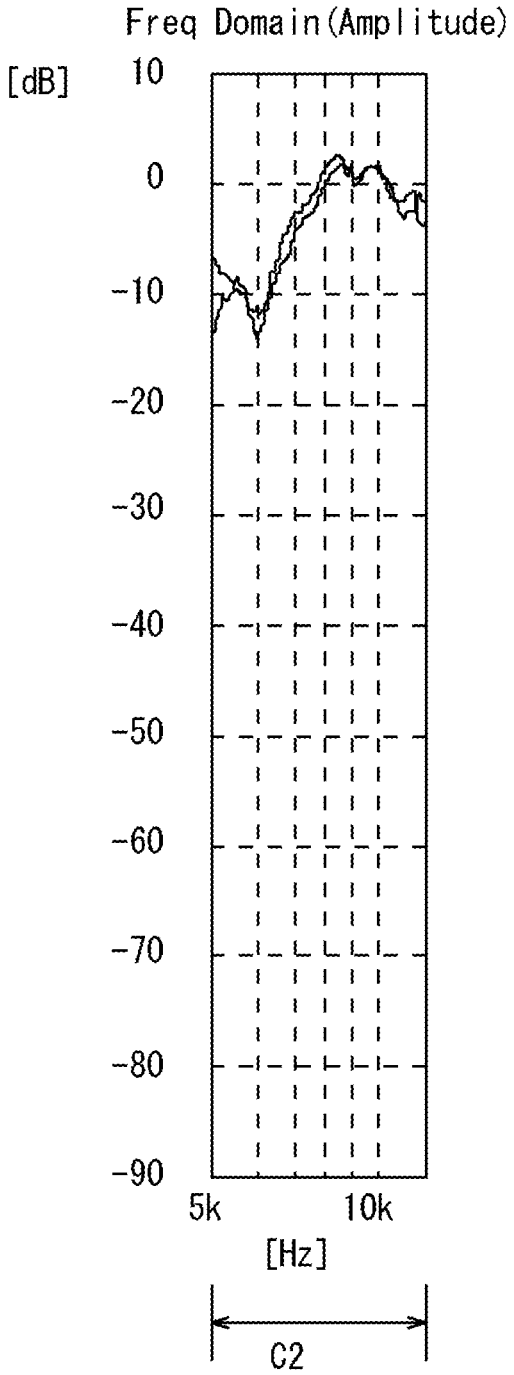
FIG. 15 is a graph showing frequency-amplitude characteristics when a left/right correlation coefficient is high.
Figure 16:
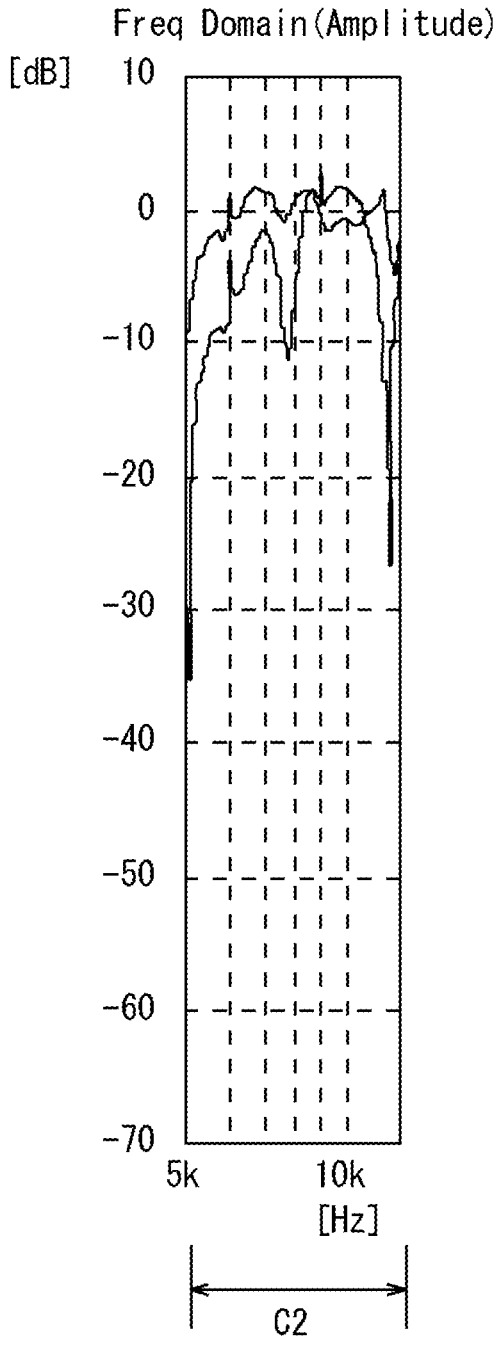
FIG. 16 is a graph showing frequency-amplitude characteristics when the left/right correlation coefficient is low.

Next, details of a step for selecting a correction pattern are explained with reference to FIGS. 14 to 16. FIG. 14 is a flowchart showing details of the step for selecting a correction pattern. FIGS. 15 and 16 are graphs showing left and right frequency-amplitude characteristics B. FIG. 15 is a graph showing frequency-amplitude characteristics when a correlation coefficient between left and right built-in microphone characteristics B is high. FIG. 16 is a graph showing frequency-amplitude characteristics when the correlation coefficient between left and right built-in microphone characteristics B is low. Specifically, the correlation coefficient is 0.91 in FIG. 15 and is 0.41 in FIG. 16. The correlation coefficient is a value obtained by dividing (a covariance between left and right built-in microphone characteristics) by (a product of standard deviations of left and right built-in microphone characteristics). Note that the correlation coefficient between the left and right built-in microphone characteristics B may be calculated only in the second frequency band (a range indicated by C2 in each of FIGS. 15 and 16).

In this embodiment, the method for selecting left and right correction patterns are changed according to the correlation coefficient between the left and right built-in microphone characteristics B. Specifically, the correction unit 33 obtains a correlation coefficient between left and right built-in microphone characteristics B in the second frequency band. Then, the correction unit 33 compares the obtained correlation coefficient with a predetermined threshold. Note that the threshold is set to 0.75. Then, when the correlation coefficient is equal to or larger than the threshold, the same correction pattern is selected for the left and right sides, whereas when the correlation coefficient is smaller than the threshold, different correction patterns can be selected for the left and right sides.

Firstly, the correction unit 33 obtains a correlation coefficient and determines whether the obtained correlation coefficient is equal to or larger than a threshold (S31). Note that the correlation coefficient may be calculated at an arbitrary timing. For example, the calculation may be performed in any of the steps S11 to S13 in FIG. 12. Further, the display unit 34 may display the obtained correlation coefficient.

When the correlation coefficient is equal to or larger than the threshold (YES at S31), white noises are alternately input on left and right sides (S32). Then, the filter units 41 and 42 perform convolution processing while successively selecting correction filters according to the first to third correction patterns (S33). For example, the filter units 41 and 42 convolute correction filters into white noises. Then, the headphones 43 outputs the white noises into which the correction filters are convoluted. In this example, the user U performs an audibility test three times.

In the first audibility test, the left and right filter units 41 and 42 convolute the first correction filter. Then, the headphones 43 alternately output the white noises with the first correction filter convoluted therein from the left and right sides. In the second audibility test, the left and right filter units 41 and 42 convolute the second correction filter. Then, the headphones 43 alternately output the white noises with the second correction filter convoluted therein from the left and right sides. In the third audibility test, the left and right filter units 41 and 42 convolute the third correction filter. Then, the headphones 43 alternately output the white noises with the third correction filter convoluted therein from the left and right sides.

Needless to say, the order in which the first to third correction patterns are convoluted is not limited to any particular orders. Note that the correction patterns may be automatically changed, or may be manually changed. In the case of the manual changed, for example, the user U may push a switch button provided in the input unit 31. In the case of the automatic changed, an audibility test according to a respective correction pattern may be switched at regular time intervals.

Next, the user selects a correction pattern in which there is no peculiarity in its sound quality (S34). Among the three audibility tests, a correction pattern in which the user can hear the white noises with the least peculiarity in the sound quality is selected. Specifically, the user U pushes a button provided in the input unit 31 so that an optimal correction pattern is input. In response to the input from the user U, the input unit 31 outputs the optimal correction pattern to the correction unit 33. In this way, the optimal correction pattern is selected. Note that the input by the user is not limited to the button. That is, a touch-panel input, a voice input, etc. may be used.

On the other hand, when the correlation coefficient is smaller than the threshold (NO at S31), white noises are input in only one of the channels (S35). In this example, white noises are input only in an L-channel. Then, the filter unit 41 performs convolution processing while successively selecting correction filters of the first to third correction patterns (S36). For example, the filter unit 41 convolutes correction filters into white noises. Then, the headphones 43 outputs the white noises with the correction filters convoluted therein. In this example, the user U performs an audibility test three times.

In the first audibility test, the filter unit 41 convolutes the first correction filter. Then, the output unit 43L of the headphones 43 outputs the white noises with the first correction filter convoluted therein. In the second audibility test, the filter unit 41 convolutes the second correction filter. Then, the output unit 43L of the headphones 43 outputs the white noises with the second correction filter convoluted therein. In the third audibility test, the filter unit 41 convolutes the third correction filter. Then, the output unit 43L of the headphones 43 outputs the white noises with the third correction filter convoluted therein. Needless to say, the order in which the first to third correction patterns are convoluted is not limited to any particular orders.

Next, the user selects a correction pattern in which there is no peculiarity in its sound quality (S37). That is, among the three audibility tests, a correction pattern in which the user can hear the white noises with the least peculiarity in the sound quality is selected. Specifically, the user U pushes a button provided in the input unit 31 so that an optimal correction pattern is input. In response to the input from the user U, the input unit 31 outputs the optimal pattern to the correction unit 33. In this way, the optimal correction pattern is selected for the L-channel. Note that the input by the user is not limited to the button. That is, a touch-panel input, a voice input, etc. may be used. Next, it is determined whether or not selections for the left and right sides are finished (S38). At this point, since the selection for the right side is not finished (NO at S38), white noises are input only in a right channel. Then, similarly to the left channel, the filter unit 42 performs convolution processing for the right channel while successively selecting correction filters of the first to third correction patterns (S36). In this way, three audibility tests are performed for the right ear, too. Then, the user U selects a correction pattern in which there is no peculiarity in its sound quality by operating the input unit 31 (S37). When the selections for both of the left and right sides are finished (YES at S38), the selection is finished.

Note that in the above explanation, the same correction pattern is selected for the left and right sides when the correlation coefficient between the left and right built-in microphone characteristics B is equal to or larger than the threshold. However, a correlation coefficient between inverse filters (1/B) may be used. That is, the same correction pattern may be selected for the left and right sides when the correlation coefficient between the left and right built-in microphone characteristics B or between left and right inverse filters (1/B) is equal to or larger than a threshold.

Further, the threshold for the correlation coefficient is not limited to 0.75. An appropriate threshold may be set according to the headphones 43. Further, in the above explanation, when the correlation coefficient is lower than the threshold, an audibility test for the left side is first carried out and then an audibility test for the right side is carried out. However, the audibility test for the left side may be carried out after the audibility test for the right side is carried out.

Correction Unit 33

Figure 17:
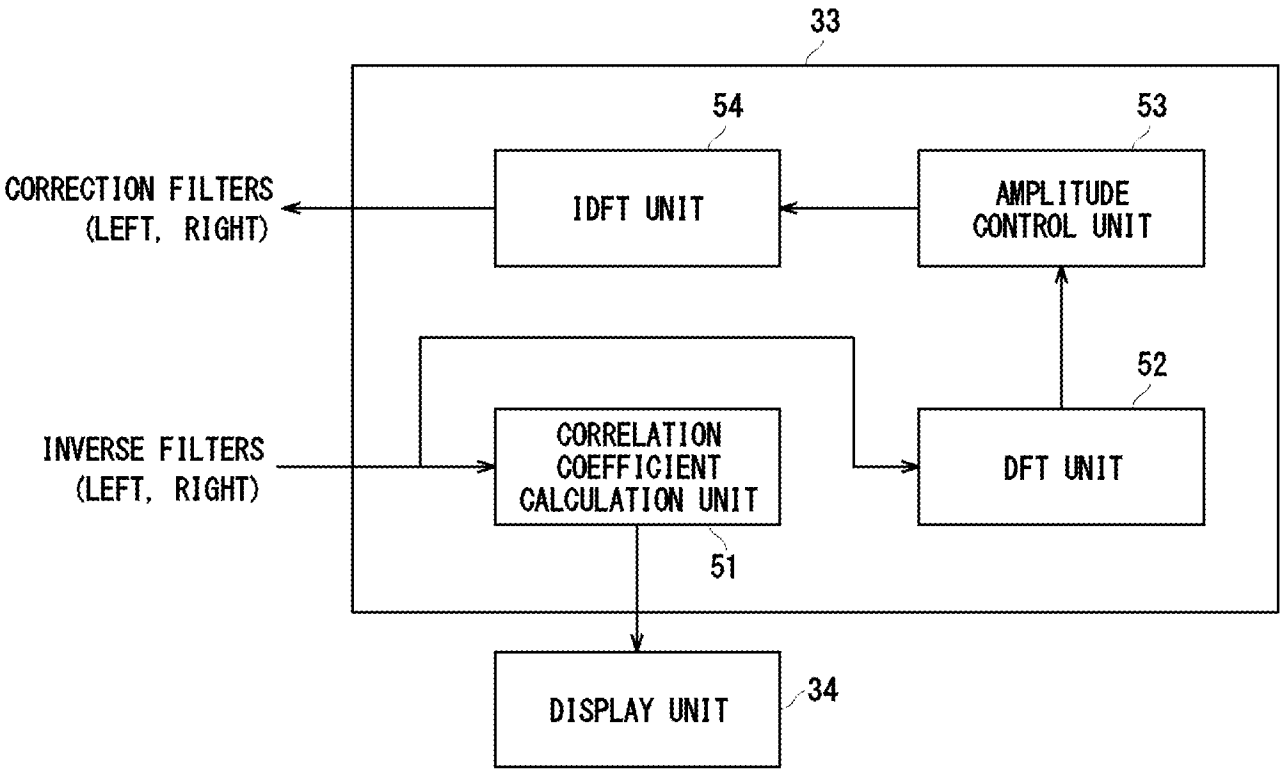
FIG. 17 is a block diagram showing an example of a correction unit.

Next, a configuration of the correction unit 33 for correcting inverse filters in order to generate correction filters is explained with reference to FIG. 17. FIG. 17 is a block diagram showing an example of the correction unit 33. The correction unit 33 includes a correlation coefficient calculation unit 51, a DFT unit 52, an amplitude control unit 53, and an IDFT unit 54.

Left and right inverse filters (1/B) output from the inverse-filter calculation unit 32 are input to the correlation coefficient calculation unit 51. The correlation coefficient calculation unit 51 calculates a correlation coefficient between left and right inverse filters (1/B). The correlation coefficient calculation unit 51 calculates a left/right correlation coefficient in the second frequency band. The correlation coefficient calculation unit 51 outputs the calculated correlation coefficient to the display unit 34. The display unit 34 displays the correlation coefficient. Needless to say, the correlation coefficient calculation unit 51 may calculate a correlation coefficient between built-in microphone characteristics B, instead of calculating the correlation coefficient between left and right inverse filters (1/B).

Inverse filters (1/B) are input to the DFT unit 52. The DFT unit 52 performs a discrete Fourier transform on the inverse filters (1/B) in a time domain. In this way, frequency-amplitude characteristics and frequency-phase characteristics are calculated. The amplitude control unit 53 controls amplitudes of inverse filters (1/B). As described above, the amplitude is changed according to the frequency band.

The IDFT unit 54 performs an inverse discrete Fourier transform on the amplitude-changed frequency-amplitude characteristics and the phase characteristics. In this way, correction filters in the time domain are generated. The correction filters are output to the filter units 41 and 42. Then, as described above, these correction filters are convoluted into reproduced signals.

Note that in the above explanation, amplitude spectrums of built-in microphone characteristics B, inverse filters (1/B), and correction filters are calculated. However, power spectrums may be obtained. Then, correction filters may be obtained by controlling power values of the power spectrums of inverse filters (1/B). That is, correction filters may be calculated by controlling inverse filters (amplitude values or power values).

Further, specific correction processing performed in the correction unit 33 may be changed for each headphone 43. That is, for the same type of headphones 43, amplitudes can be controlled by using the same correction function and/or the same constant value. Needless to say, for different types of headphones 43, an optimal correction function and an optimal constant value may be set for each of them. Specifically, for a certain type of headphones 43, its manufacturer measures ear-microphone characteristics (A) and built-in microphone characteristics (B). Then, correction patterns, an upper-limit frequency and a lower-limit frequency for each frequency band, setting values for amplitudes in each frequency band, correction functions, etc. are determined by analyzing measurement results of the ear-microphone characteristics (A) and the built-in microphone characteristics (B). The manufacturer provides a computer program for making corrections and performing out-of-head localization processing to a user who purchases headphones equipped with built-in microphones. Then, as the user executes the computer program, a process for correcting inverse filters and out-of-head localization processing are performed.

Some or all of the above-described processes may be performed by using a computer program. The above-described program can be stored in various types of non-transitory computer readable media and thereby supplied to the computer. The non-transitory computer readable media includes various types of tangible storage media. Examples of the non-transitory computer readable media include a magnetic recording medium (such as a flexible disk, a magnetic tape, and a hard disk drive), a magneto-optic recording medium (such as a magneto-optic disk), a CD-ROM (Read Only Memory), a CD-R, and a CD-R/W, and a semiconductor memory (such as a mask ROM, a PROM (Programmable ROM), an EPROM (Erasable PROM), a flash ROM, and a RAM (Random Access Memory)). Further, the program can be supplied to the computer by using various types of transitory computer readable media. Examples of the transitory computer readable media include an electrical signal, an optical signal, and an electromagnetic wave. The transitory computer readable media can be used to supply programs to the computer through a wire communication path such as an electrical wire and an optical fiber, or wireless communication path.

The present disclosure made by the inventors of the present application has been explained above in a concrete manner based on embodiments. However, the present disclosure is not limited to the above-described embodiments, and needless to say, various modifications can be made without departing from the spirit and scope of the present disclosure.

The present disclosure can be applied to out-of-head localization processing using headphones.

What is claimed is:

1. An out-of-head localization processing apparatus comprising:

headphones comprising left and right output units;

left and right microphones attached to the left and right output units, respectively;

a measurement unit configured to collect sounds output from the left and right output units by using the left and right microphones, respectively, and thereby measure left and right headphone transfer characteristics, respectively;

an inverse-filter calculation unit configured to calculate inverse filters of the left and right headphone transfer characteristics, respectively, in a frequency domain;

a correction unit configured to calculate correction filters by correcting the inverse filters in the frequency domain;

a convolution calculation unit configured to perform convolution processing for reproduced signals by using spatial acoustic transfer characteristics;

a filter unit configured to perform convolution processing for the reproduced signal, which has been subjected to the convolution processing in the convolution calculation unit, by using the correction filters; and an input unit configured to receive a user input for selecting an optimal correction pattern from among a plurality of correction patterns, wherein the headphones output the reproduced signal into which the correction filters are convoluted, and the correction unit:

corrects the inverse filters by using a predefined correction function in a first frequency band;

corrects the inverse filters according to the correction pattern selected based on the user input in a second frequency band higher than the first frequency band; and corrects the correction filters to a predetermined value in a third frequency band higher than the second frequency band.

2. The out-of-head localization processing apparatus according to claim 1, wherein when a correlation coefficient between the left and right headphone transfer characteristics or between the left and right inverse filters is equal to or larger than a predetermined threshold in the second frequency band, the correction unit selects the same correction pattern for left and right sides.

3. The out-of-head localization processing apparatus according to claim 1, wherein the plurality of correction patterns includes:

a first correction pattern in which the inverse filters are used as the correction filters in the second frequency band;

a second correction pattern in which the correction filters are set to a constant value in the second frequency band; and a third correction pattern in which the inverse filters are amplified or attenuated and set as the correction filters in the second frequency band.

4. An out-of-head localization processing method using an out-of-head localization processing apparatus, the out-of-head localization processing apparatus comprising:

headphones comprising left and right output units;

left and right microphones attached to the left and right output units, respectively; and an input unit configured to receive a user input for selecting an optimal correction pattern from among a plurality of correction patterns, the out-of-head localization processing method comprising:

a step of collecting sounds output from the left and right output units by using the left and right microphones, respectively, and thereby measuring left and right headphone transfer characteristics, respectively;

a step of calculating inverse filters of the left and right headphone transfer characteristics in a frequency domain;

a step of correcting the inverse filters by using a plurality of correction patterns and thereby generating a plurality of correction filters corresponding the plurality of correction patterns in the frequency domain;

a step of selecting an optimal correction pattern from among the plurality of correction patterns;

a convolution step of performing convolution processing for reproduced signals by using spatial acoustic transfer characteristics;

a step of performing convolution processing for the reproduced signals, into which spatial acoustic transfer characteristics are convoluted, by using the correction filters; and a step of outputting the reproduced signals, into which the correction filters are convoluted, from the headphones, wherein in the step of generating the correction filters, the inverse filters are corrected by using a predefined correction function in a first frequency band;

the inverse filters are corrected according to the correction pattern selected based on the user input in a second frequency band higher than the first frequency band; and the correction filters are corrected to a predetermined value in a third frequency band higher than the second frequency band.

5. The out-of-head localization processing method according to claim 4, wherein when a correlation coefficient between the left and right headphone transfer characteristics or between the left and right inverse filters is equal to or larger than a predetermined threshold in the second frequency band, the same correction pattern is selected for left and right sides.

6. The out-of-head localization processing method according to claim 4, wherein the plurality of correction patterns includes:

a first correction pattern in which the inverse filters are used as the correction filters in the second frequency band;

a second correction pattern in which the correction filters are set to a constant value in the second frequency band; and a third correction pattern in which the inverse filters are amplified or attenuated and set as the correction filters in the second frequency band.

* * * * *